US009622538B2

(12) United States Patent
Deitesfeld

(10) Patent No.: US 9,622,538 B2
(45) Date of Patent: Apr. 18, 2017

(54) SPORT BOOT

(71) Applicant: Zay Products, Inc., Longmont, CO (US)

(72) Inventor: Rex Deitesfeld, Longmont, CO (US)

(73) Assignee: Zay Products, Inc., Longmont, CO (US)

( * ) Notice: Subject to any disclaimer, the term of this patent is extended or adjusted under 35 U.S.C. 154(b) by 0 days.

(21) Appl. No.: 14/495,495

(22) Filed: Sep. 24, 2014

(65) Prior Publication Data

US 2015/0082666 A1 Mar. 26, 2015

Related U.S. Application Data

(60) Provisional application No. 61/882,589, filed on Sep. 25, 2013.

(51) Int. Cl.

| | |
|---|---|
| ***A43B 5/04*** | (2006.01) |
| *A43C 1/00* | (2006.01) |
| *A43C 11/16* | (2006.01) |

(52) U.S. Cl.

CPC ..... *A43B 5/0449* (2013.01); *A43C 1/00* (2013.01); *A43C 11/165* (2013.01); *Y10T 24/2158* (2015.01); *Y10T 24/3916* (2015.01)

(58) Field of Classification Search

CPC ..... A43B 5/0449; A43C 1/00; A43C 5/00; A43C 11/00; A43C 11/12; A43C 11/165; A43C 1/006

USPC ..... 36/117.1, 117.2, 117.7, 117.8, 117.9, 36/118.1, 50.1

See application file for complete search history.

(56) References Cited

U.S. PATENT DOCUMENTS

| | | | | |
|---|---|---|---|---|
| D205,993 S | | 10/1966 | Ali | |
| 4,360,979 A | * | 11/1982 | Spademan | A43B 5/0447 36/118.8 |
| 4,408,403 A | | 10/1983 | Martin | |

(Continued)

FOREIGN PATENT DOCUMENTS

| | | |
|---|---|---|
| DE | 3342331 | 5/1984 |
| DE | 3247516 | 6/1984 |

(Continued)

OTHER PUBLICATIONS

English Abstract of EP0114209, Aug. 1, 1984, 1 pp.

(Continued)

*Primary Examiner* — Shaun R Hurley
*Assistant Examiner* — Bao-Thieu L Nguyen
(74) *Attorney, Agent, or Firm* — Trenner Law Firm, LLC; Mark D. Trenner

(57) ABSTRACT

An example sport boot includes at least one terminator provided in a cavity formed in a base of the sport boot. A first cable having a first end terminating in a first receptacle of the at least one terminator extends out of a first side of the base of the sport boot, around a foot portion of the sport boot and into a second side of the base of the sport boot. A second end of the first cable terminates in a second receptacle of the at least one terminator. A second cable having a first end terminating in a third receptacle of the at least one terminator extends out of a rear side of the base of the sport boot and is attached to a handle mounted on the rear (cuff) portion of the sport boot.

20 Claims, 26 Drawing Sheets

(56) References Cited

U.S. PATENT DOCUMENTS 4,433,456 A * 2/1984 Baggio ..... A43C 11/16 24/68 B
4,654,985 A 4/1987 Chalmers
4,670,999 A * 6/1987 Olivieri ..... A43B 5/0449 36/117.7
4,757,621 A * 7/1988 Iwama ..... A43B 5/0449 36/117.8
4,922,634 A * 5/1990 Seidel ..... A43B 3/0005 36/117.8
4,928,408 A * 5/1990 Baggio ..... A43B 5/0439 36/117.8
4,937,953 A * 7/1990 Walkhoff ..... A43B 5/0449 36/117.7
4,984,375 A * 1/1991 Bonnet ..... A43B 5/0427 36/117.8
5,175,949 A * 1/1993 Seidel ..... A43B 5/0435 36/117.8
5,325,613 A * 7/1994 Sussmann ..... A43C 11/00 24/712.2
5,839,210 A * 11/1998 Bernier ..... A43B 1/0072 36/138
6,032,387 A * 3/2000 Johnson ..... A43C 1/06 36/118.1
6,378,230 B1 * 4/2002 Rotem ..... A43C 11/16 36/118.1
6,896,128 B1 * 5/2005 Johnson ..... A43C 1/06 36/118.1
7,096,559 B2 * 8/2006 Johnson ..... A43B 11/00 29/433
7,661,205 B2 * 2/2010 Johnson ..... A43C 7/04 36/50.1
7,721,468 B1 * 5/2010 Johnson ..... A43C 1/06 36/118.1
8,904,672 B1 * 12/2014 Johnson ..... A43B 5/04 36/138
2002/0174570 A1 * 11/2002 Proctor ..... A43B 5/0472 36/117.1
2004/0226151 A1 * 11/2004 St-Louis ..... A43C 7/00 24/715.4
2004/0226190 A1 * 11/2004 Elkington ..... A43B 5/0401 36/50.5
2013/0283642 A1 * 10/2013 Pieber ..... A43B 5/0486 36/117.2

FOREIGN PATENT DOCUMENTS

EP 0114209 8/1984
FR 2399811 3/1979

OTHER PUBLICATIONS

Google English Translation of EP 0113908—noted as being also published as DE 3247516, Jun. 28, 1984, 11 pp.
English Abstract of DE3342331, May 24, 1984, 1 pp.
English Abstract of FR2399811, Mar. 9, 1979, 1 pp.

* cited by examiner

SPORT BOOT

PRIORITY CLAIM AND RELATED APPLICATIONS

This application claims the priority benefit of U.S. Provisional Patent Application No. 61/882,589 filed Sep. 25, 2013 and titled "Enhanced Sport Boot" of Rex Deitesfeld, hereby incorporated by reference in its entirety as though fully set forth herein. This application is also related to U.S. Pat. No. 4,654,985, hereby incorporated by reference in its entirety as though fully set forth herein.

BACKGROUND

Various types of footwear, for example, ski boots, include rigid shells surrounding a soft interior designed to comfortably grip a wearer's foot. In some designs, rigid shells are provided in a number of overlapping pieces allowing for expansion to enable removal of the footwear.

DETAILED DESCRIPTION

Figure 1A:
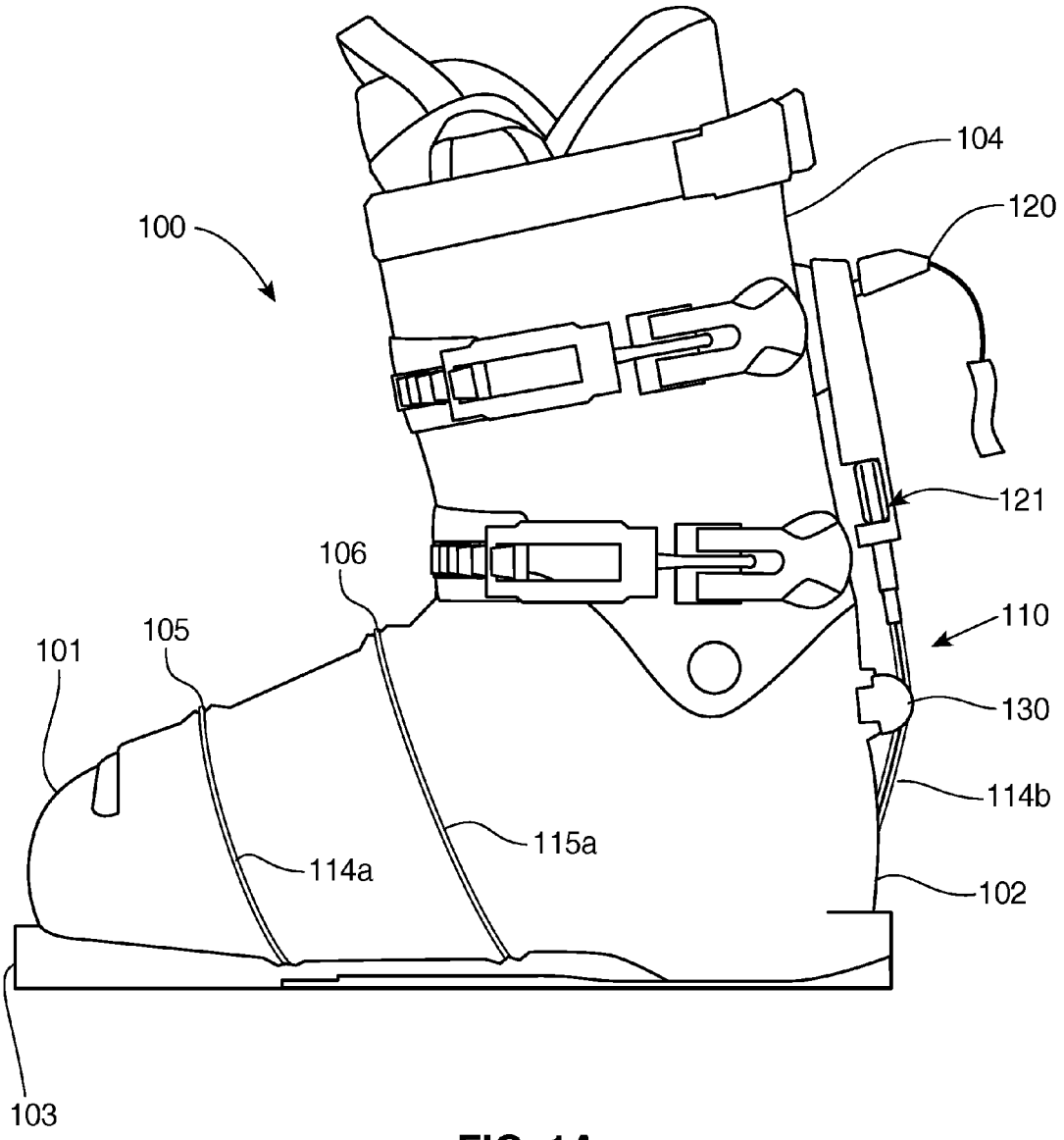
FIGS. 1A-D show various views of an example sport boot.

A sport boot is disclosed. In an example, the sport boot includes at least one terminator provided in a cavity formed in a base of the sport boot. A first cable has a first end terminating in a first receptacle of the at least one terminator. The first cable extends out of a first side of the base of the sport boot, around a foot portion of the sport boot and into a second side of the base of the sport boot. A second end of the first cable terminates in a second receptacle of the at least one terminator. A second cable has a first end terminating in a third receptacle of the at least one terminator. The second cable extends out of the heel area (rear) of the sport boot and is attached to a handle mounted on the rear (cuff) of the sport boot.

The sport boot may also have a second terminator provided in the cavity formed in the base of the sport boot. In this example, a third cable has a first end terminating in a first receptacle of the second terminator. The third cable extends out of the first side of the base of the sport boot, around the foot portion of the sport boot and into the second side of the base of the sport boot. A second end of the third cable terminates in a second receptacle of the second terminator. A fourth cable has a first end terminating in a third receptacle of the second terminator. The fourth cable extends out of a rear side of the base of the sport boot and is attached to the handle mounted on the rear (cuff) portion of the sport boot.

In an example, the terminator(s) are disc-shaped. The first and second cable each have enlarged ends configured for receipt within the receptacles of the at least one terminator. The receptacles are formed into a bottom surface of the terminator and accessed through a perimeter of the disc. The receptacles may have a radial portion having a first cross section and an interior portion having a second cross section, the second cross section larger than the first cross section to securely receive enlarged ends of the first and second cables. In an example use case, applying opposing forces to the terminator along a first orientation applies tension to the first and second cable, and wherein applying opposing forces to the terminator along a second orientation approximately perpendicular to the first orientation disengages the cable from the disc.

In an example, the sport boot may include a cable wear guide on a back side of the rear (cuff) portion of the sport boot under the handle. In this example, the second and fourth cable slide over the cable wear guide.

In an example, the second and fourth cables are attached to the handle via adjustable connectors to tighten and loosen the second and fourth cables at the handle.

In an example, the sport boot includes a power strap configured to tighten around a front upper ankle portion of the sport boot. A ridge may be provided and configured to reduce or prevent slipping of the power strap in an upward and downward direction on the front upper ankle portion of the sport boot.

In an example, the sport boot includes a boot board inside the sport boot. The boot board has first and second angled bottom surfaces, and a step down on a medial side encompassing a foam piece which aids the user's foot to articulate.

Before continuing, it is noted that as used herein, the terms "includes" and "including" mean, but is not limited to, "includes" or "including" and "includes at least" or "including at least." The term "based on" means "based on" and "based at least in part on."

FIGS. 1A-D show various views of an example sport boot 100 or other footwear. In an example, the boot 100 may include lower shell portion 101 and rearward shell portion 102 coupled with the upper shell or cuff section 104, which are formed or otherwise fastened together to establish a firm fit on the foot of a wearer while enabling sufficient flexibility for the skier. A sole or other lower boot portion 103 is provided on the bottom part of the boot 100. A cable closure or fastening system 110 is provided to tighten the boot on the user's foot.

It is noted that the fastening system 110 described herein enables use of a thinner boot wall to be provided (e.g., approximately in the range of 0.070 to 0.240 inches). than any prior ski boot may be provided, for example, to facilitate better conformance to an ankle of a wearer. The thinner boot wall may be enabled by cast polyurethane or thin-wall injection molding.

In an example, the fastening system 110 for the boot 100 is implemented as a radial cable closure. That is, the fastening system 110 may surround the entire forefoot 101, and tighten at the rear or heal 102 of the boot 100, thereby giving mechanical structure to the outer shell of the boot 100 and reducing or altogether preventing deformation of the outer shell, all while stabilizing the foot of a wearer (e.g., a skier) of the boot 100. The fastening system 110 is shown in an open or released configuration in FIGS. 1A-B (wherein handle 120 is lowered), and in a closed or secured configured in FIGS. 1C-D (wherein handle 120 is raised). In an example, the cables may be extended over a cable wear guide 130 on the back side of the rear (cuff) portion of the boot 100, to further enhance alignment and/or tensioning of the cables.

Figure 2A:
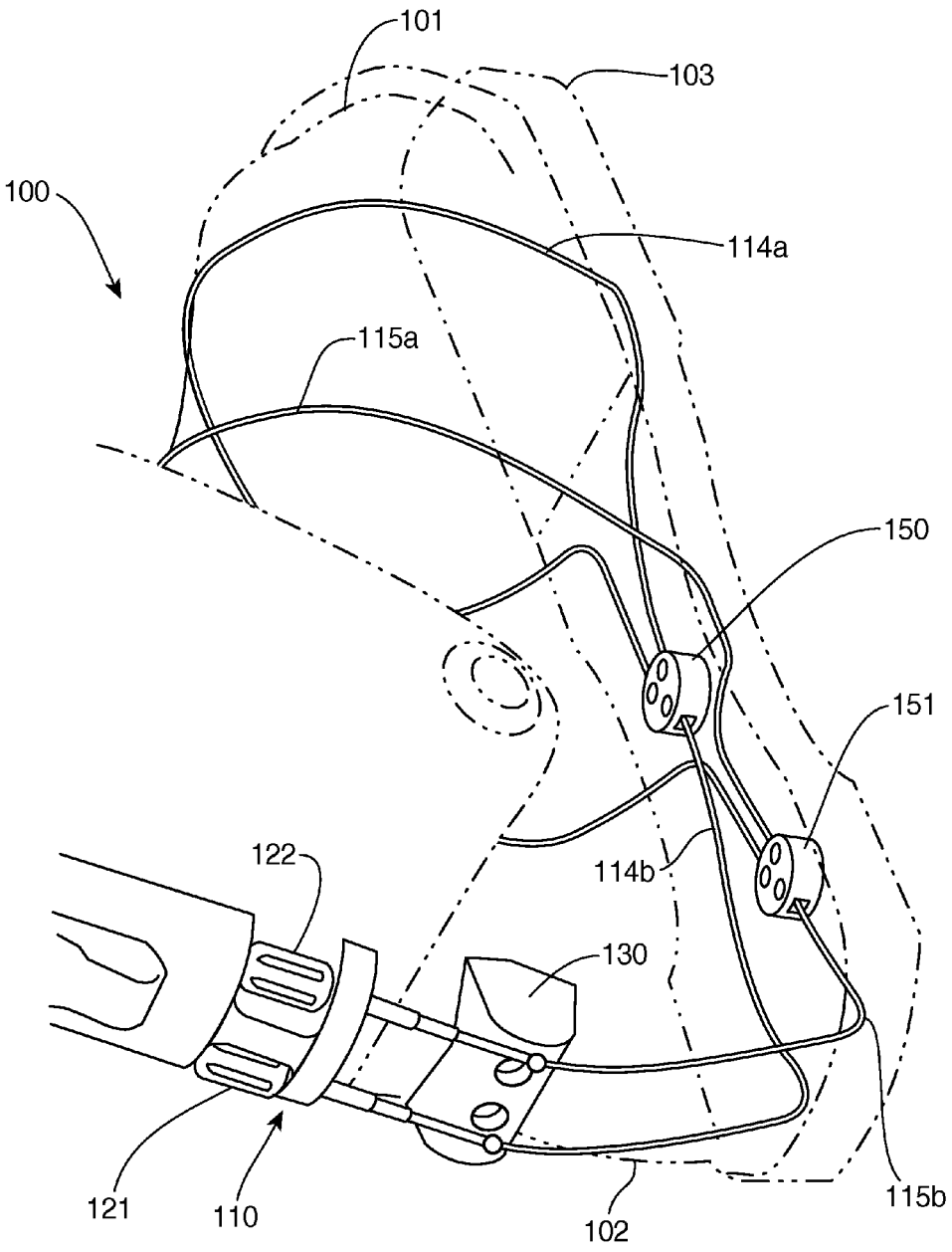
FIGS. 2A-C illustrate cables of an example cable fastening system.
Figure 2B:
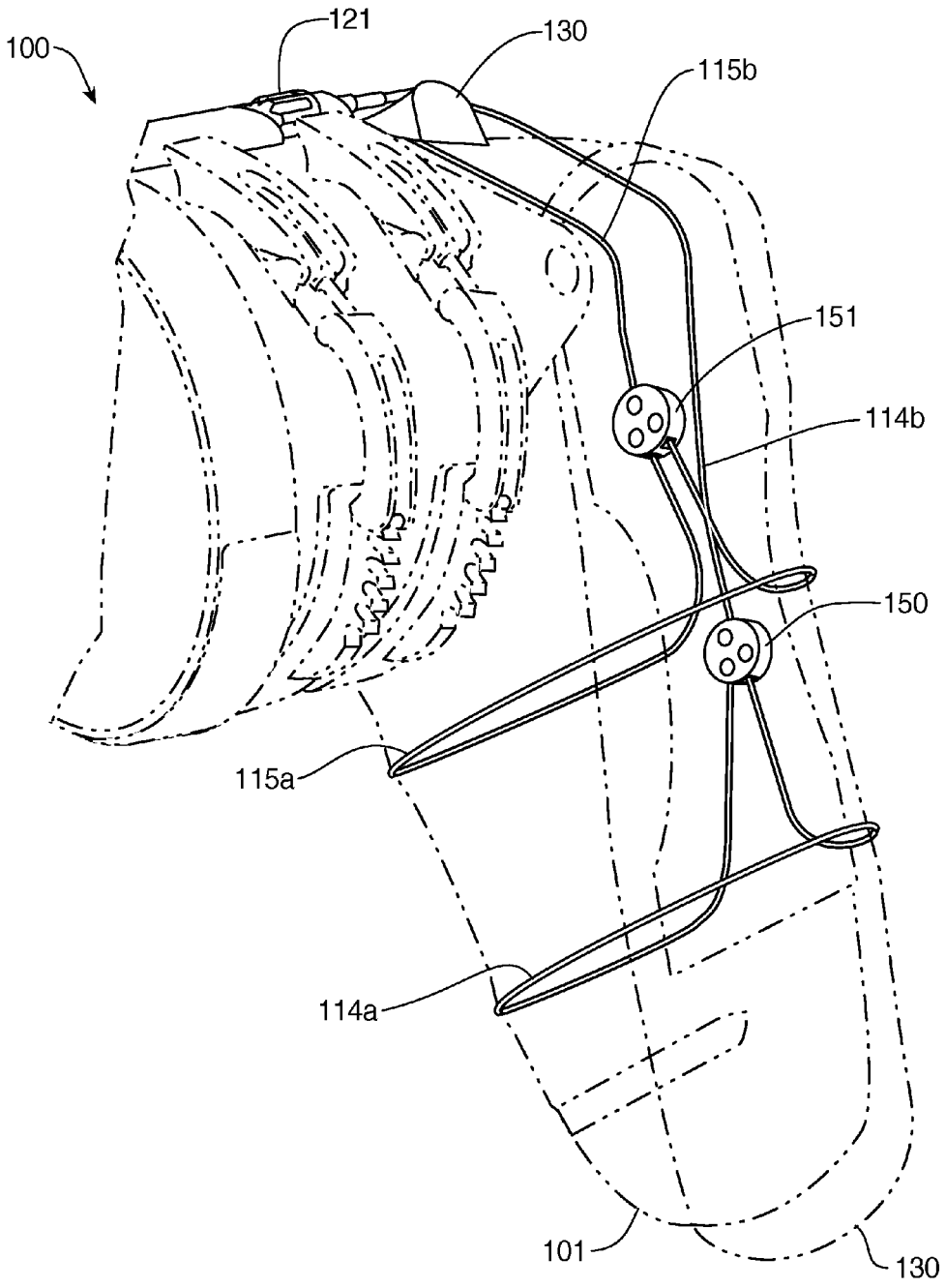
Figure 2C:
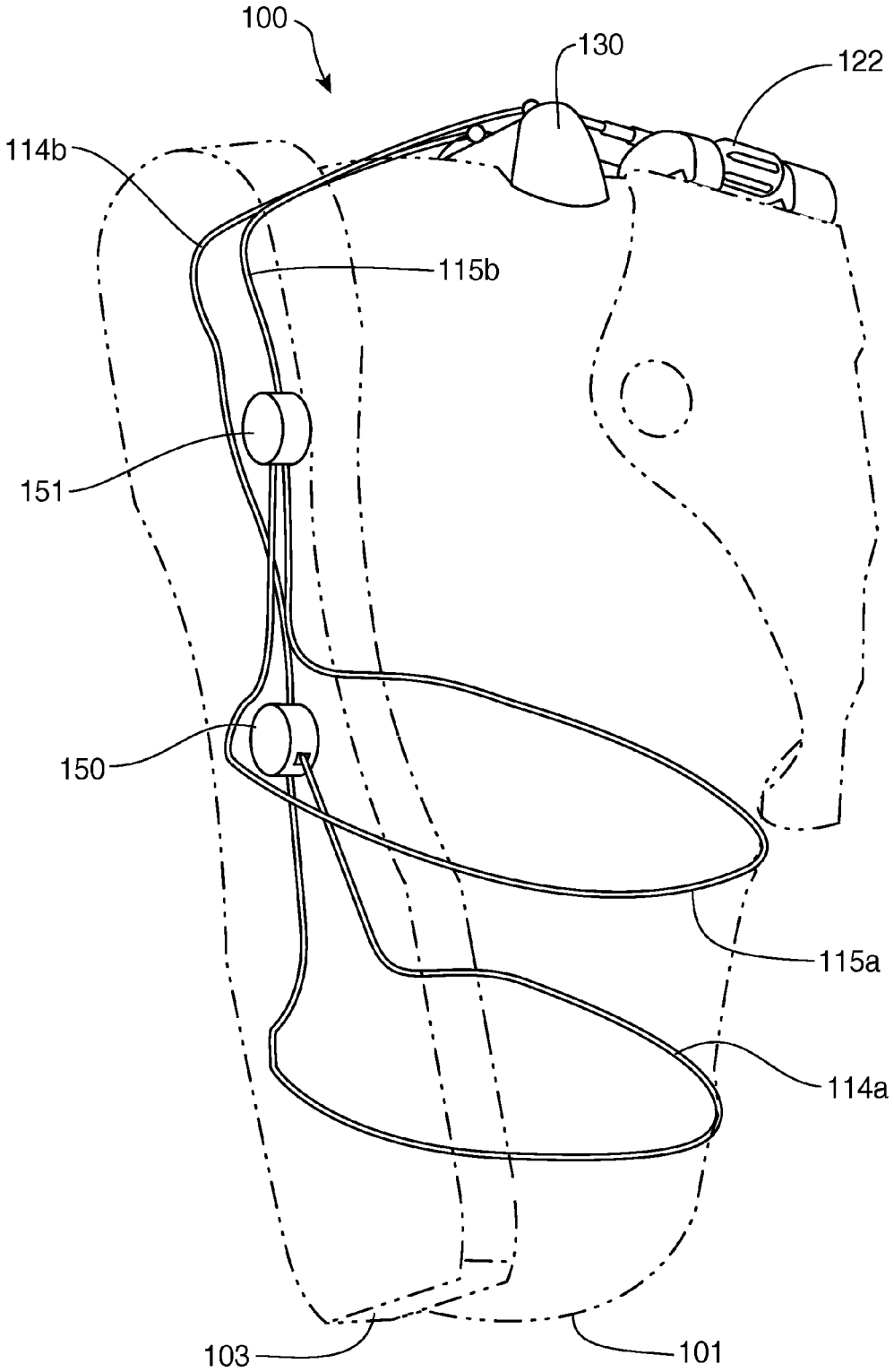

FIGS. 2A-C illustrate cables of an example cable fastening system 110. The fastening system 110 is shown as it may include one or more cable (cables 114*a-b* and 115*a-b* are shown) that surround the foot portion of the boot 100 to maintain the plastic shell from deforming at the ankle points and forward. In an example, the boot may be formed (e.g., with channels 105 and 106) to guide and protect the cables 114*a* and 115*a*, respectively, and maintain these cables in a desired location on the outer surface of the boot 100. Tightening the fastening system 110 creates a constant forward flex progressive pattern for the wearer.

It is noted that the term "progressive flex" is used herein to describe a boot condition wherein, because the cuff of the boot is not fastened to the lower portion of the boot, the cables provide for a consistent forward flex. Other boots may come to an abrupt forward position. However, the sport boot described herein comes to a stop as if there is a compression spring throughout the range, gradually stopping the flex of the boot. This condition also holds true when the boot tends to go back into its normal position. Because the cuff is attached to the cable system, there is a natural resistance developed from closing the handle of the boot, thus causing a flex (i.e., a progressive flex) to the cuff of the boot. The flex of all other boots depends upon the skier distorting the plastic at the front of the shin, and is fixed. The progressive flex of the sport boot described herein can be changed or adjusted by the user by varying how much tension is applied to the cables via the micro adjustment (e.g., thumb nuts 121 and 122).

Figure 3:
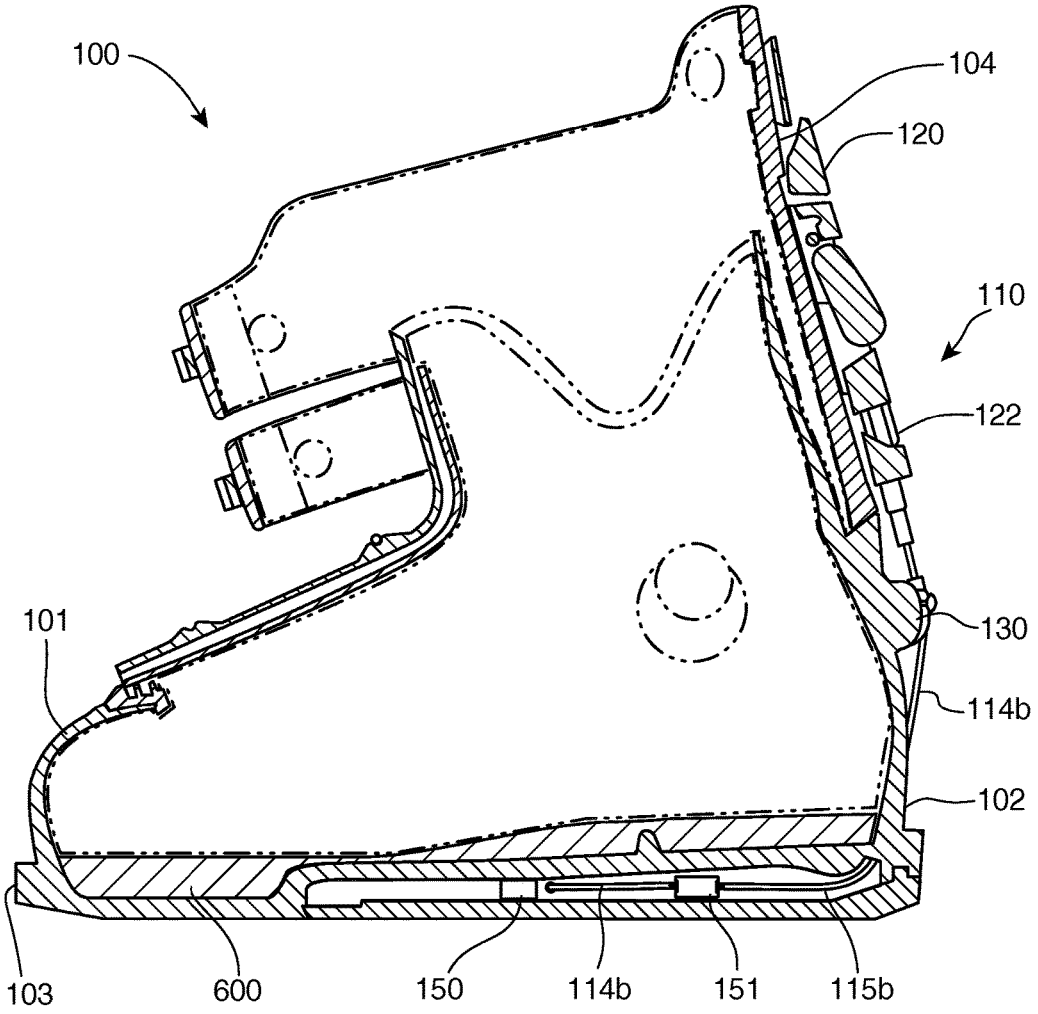
FIG. 3 is a partial cross-section showing a side view of the example sport boot.

In an example, the fastening system 100 may include a plurality of substantially disc-shaped terminators in a base portion of the boot 100. FIG. 3 is a partial cross-section showing a side view of the example sport boot, showing a relative position of the terminators 150, 151 for cables 114*a-b* in the sole of the boot 100.

Figure 1B:
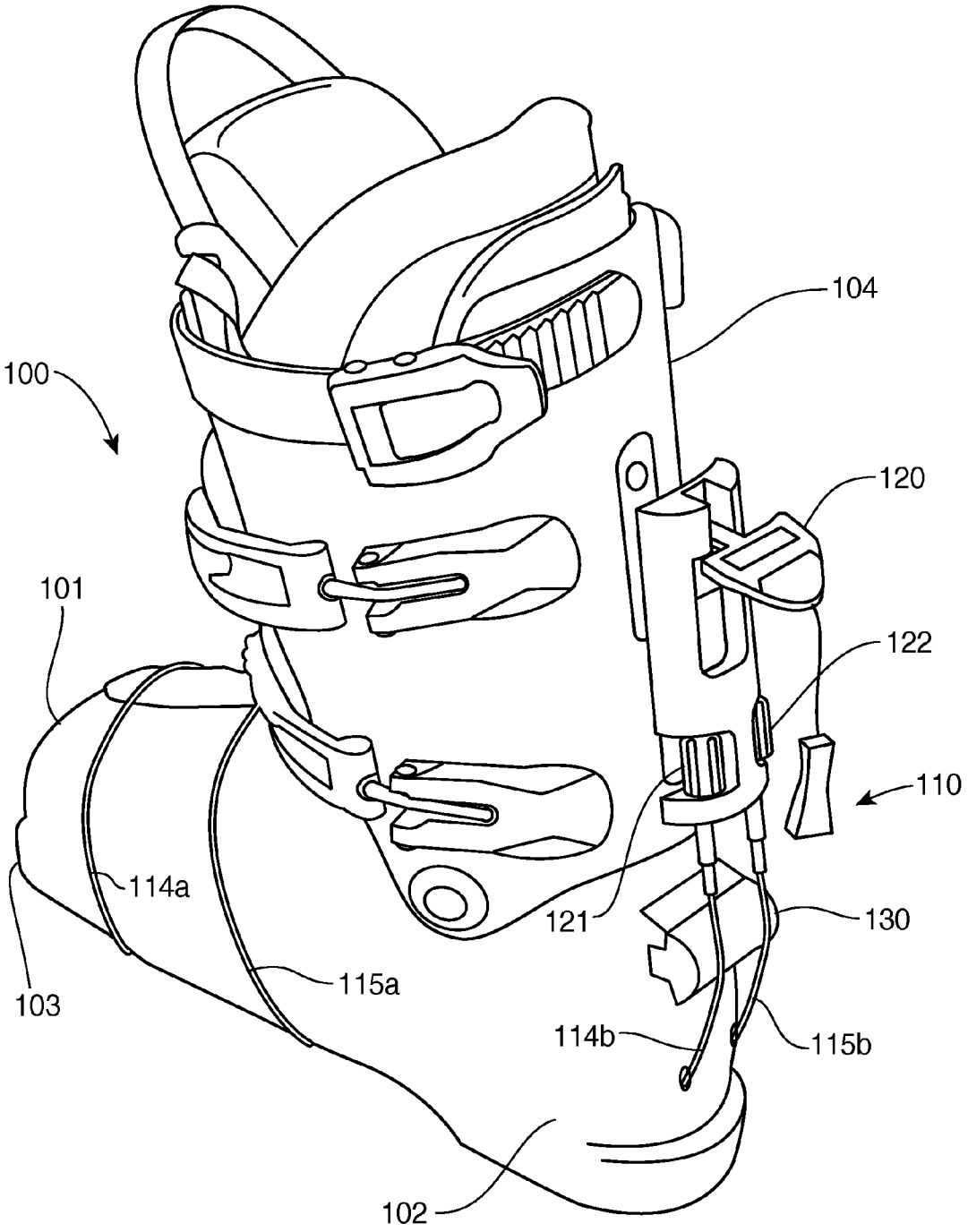
Figure 1C:
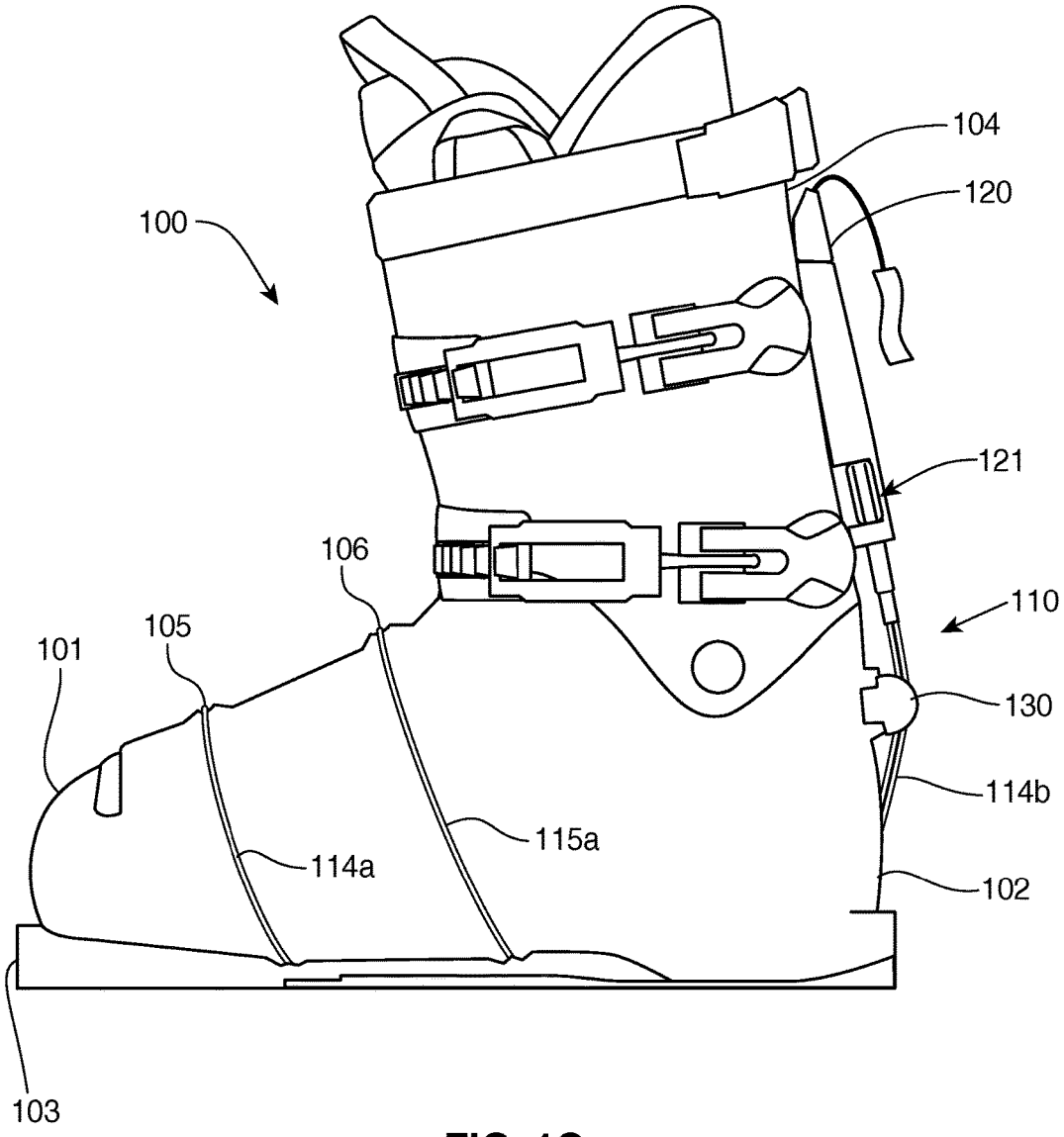
Figure 1D:
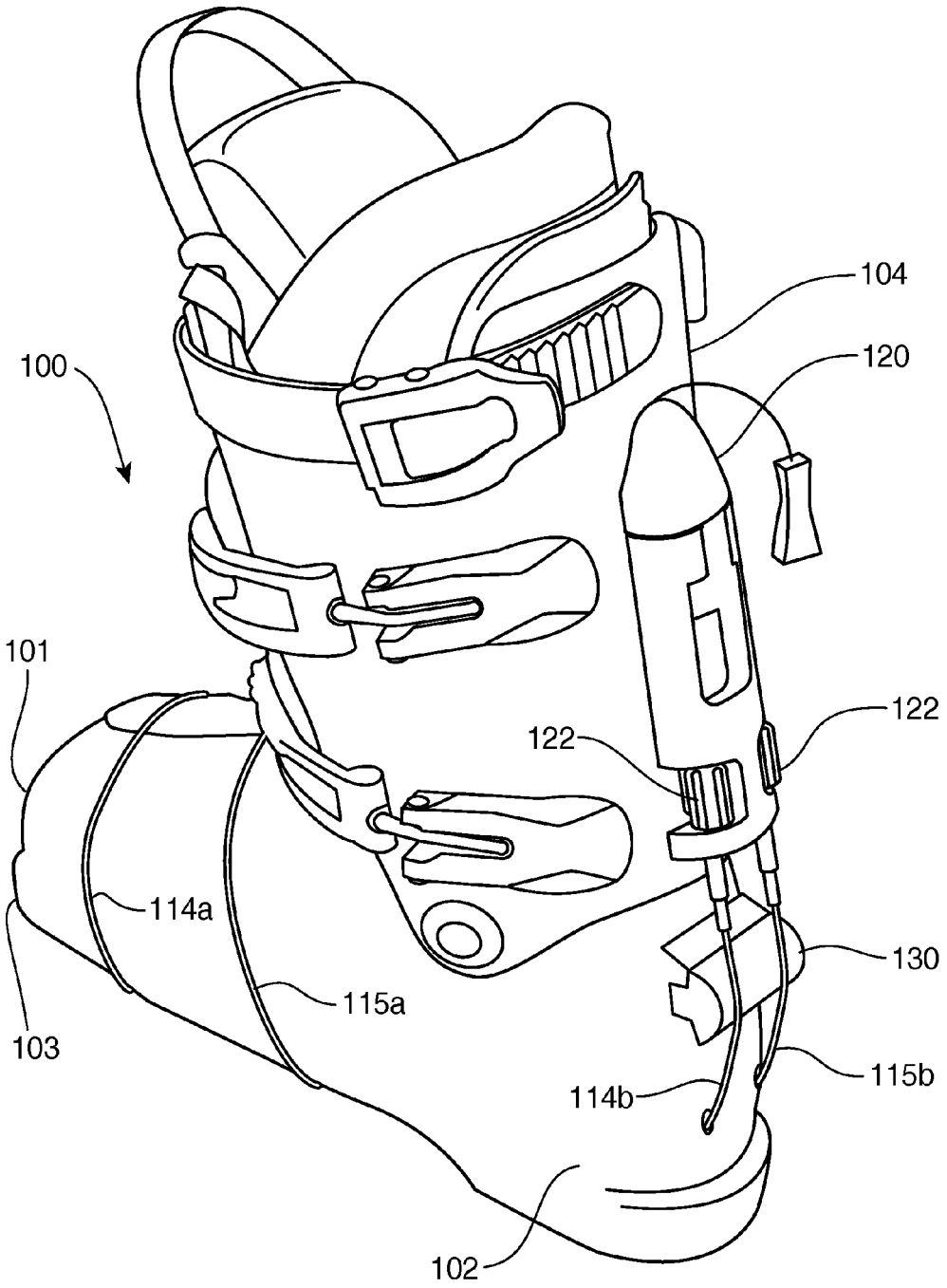

Each of the terminators have a plurality of receptacles to receive the ends of the cables 114*a* and 115*a*. For example, a first end of the first cable 114*a* is coupled to a first terminator and a first end of the second cable 115*a* is coupled to a second terminator. Another cable 114*b* and 115*b* extends from each of the terminators for the respective cables 114*a* and 115*a* and connect to a lever handle 120 on the rear (cuff) portion of the boot 100. For example, the cables 114*b* and 115*b* may be connected to cable tension assemblies 121 and 122 including thumb nut with lower hub for receiving the ends of cables 114*b* and 115*b*. Cable tension assemblies 121 and 122 may be provided to fine tune tension on the cables, e.g., when the lever handle 120 is in a released position as shown in FIG. 1B. Operating the lever handle 120 increases and decreases tension in the cables so that the boot 100 can be fitted on and/or removed from the user's foot, as illustrated by FIG. 3.

Before continuing, it is noted that although the sport boot (or "boot") is described herein primarily as the cable system may be used for a ski boot or the like, the systems and methods may also benefit other types of footwear, such as but not limited to a snowboard boot, rollerblade boot, or hiking or work boot.

Figure 4:
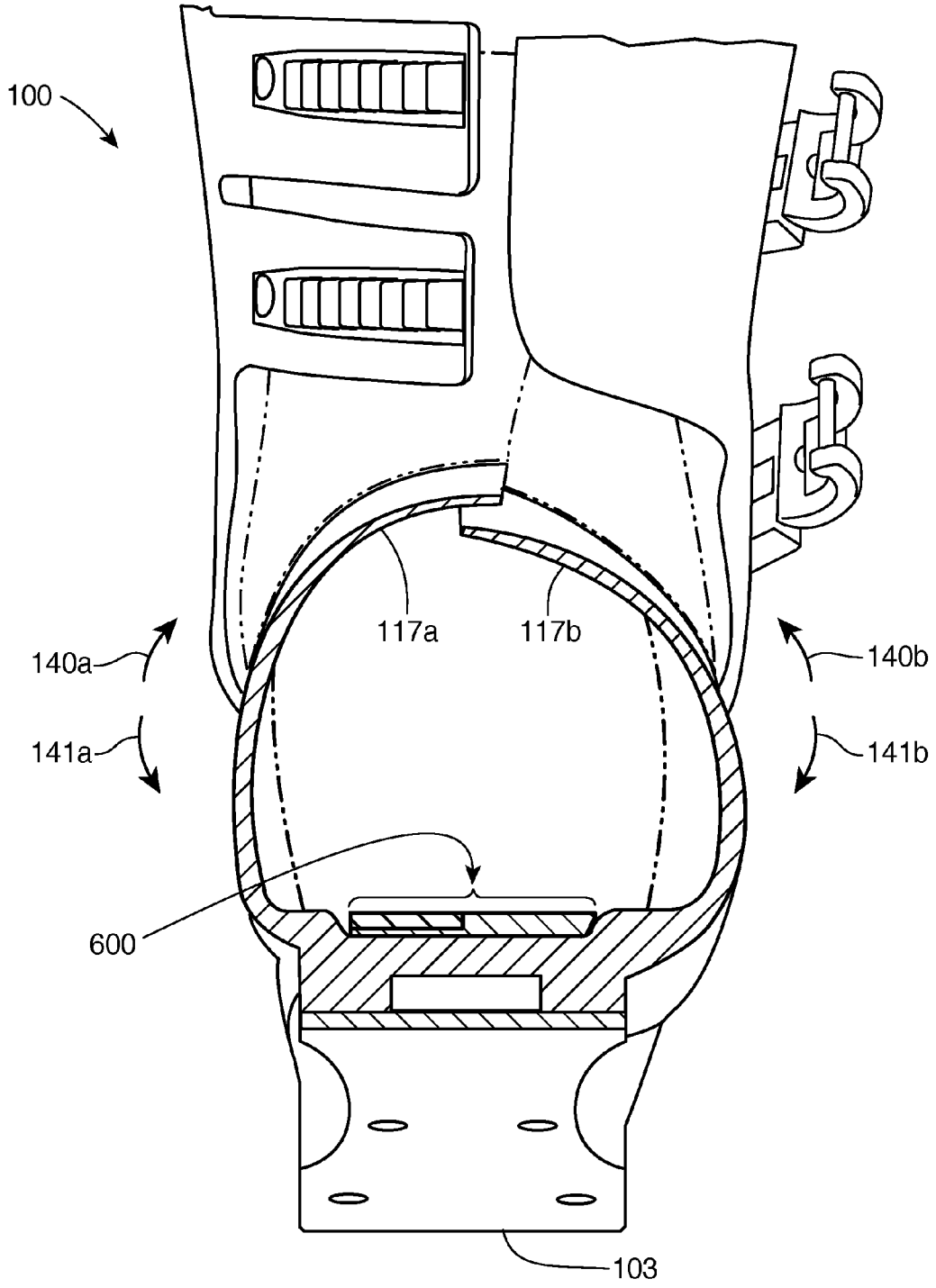
FIG. 4 is a partial cross-section showing a front view of a foot portion of the example sport boot.

FIG. 4 is a partial cross-section showing a front view of a foot portion of the example sport boot 100. It can be seen that increasing tension (e.g., by operating the lever handle 120) pulls the cables 114*a* and 115*a* (see FIGS. 1A-D) and pulls the two half shells 117*a-b* of the boot 100 together, thereby tightening around the entire user's foot, as illustrated by arrows 140*a-b*. As shown, the cable provides tension around the entire foot portion of the boot (e.g., 360 degree), instead of only across two points (e.g., when two buckles are used).

Likewise, decreasing tension (e.g., by operating the lever handle 120) releases the cables 114*a* and 115*a* (see FIGS. 1A-D) and causes the two half shells 117*a-b* of the boot 100 to expand, thereby releasing tension from around the user's foot, as illustrated by arrows 141*a-b*.

It is noted that the fastening system 110 described herein may be used in addition to, or in lieu of a buckle (or other adjustable type device) to pull the two half shells closed.

Figure 5A:
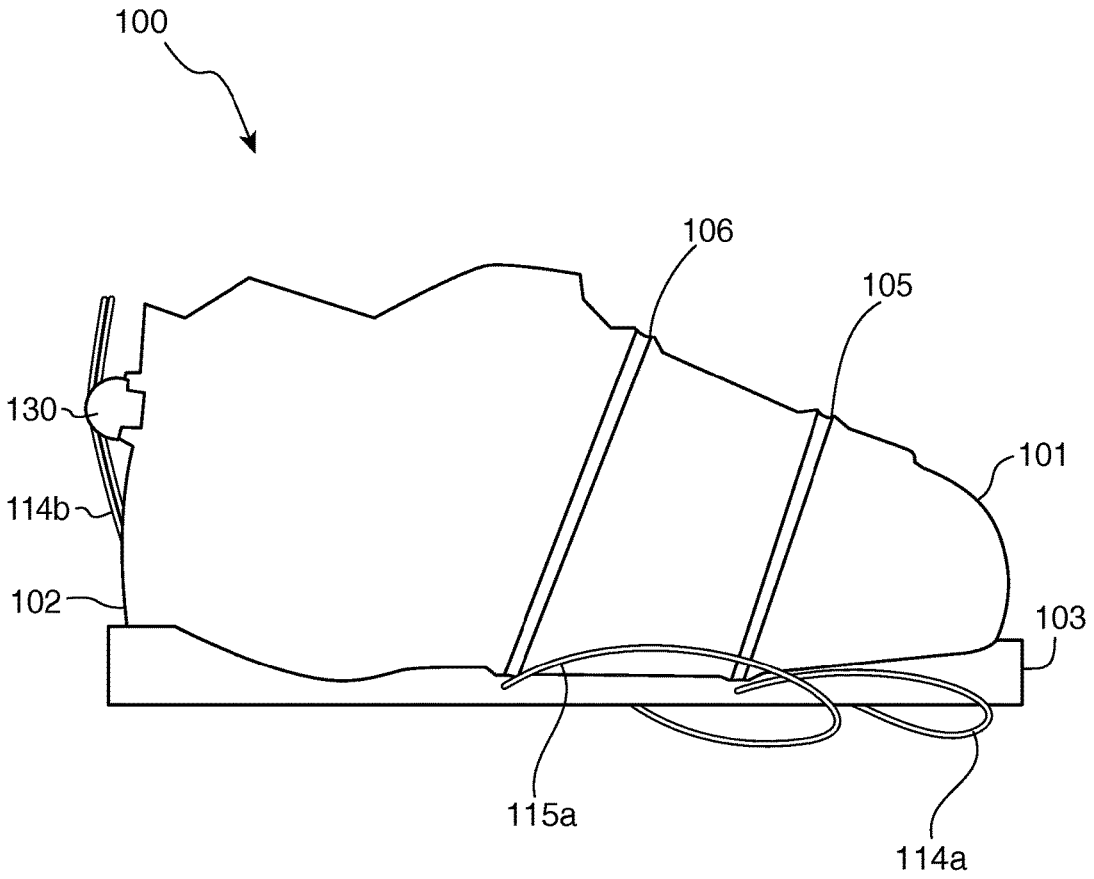
FIGS. 5A-D illustrate an example cable fastening system of the example sport boot in more detail.

FIGS. 5A-D illustrate an example cable fastening system 110 of the example sport boot 100 in more detail. In FIG. 5A, the cables 114*a* and 115*a* are shown as these may extend out of cavity 160 in the sole of the boot 100, e.g., through an opening formed in the side of the boot 100. The cables may form loops, which can be extended over the toe of the boot 100 and generally aligned with channels 105 and 106.

Figure 5B:
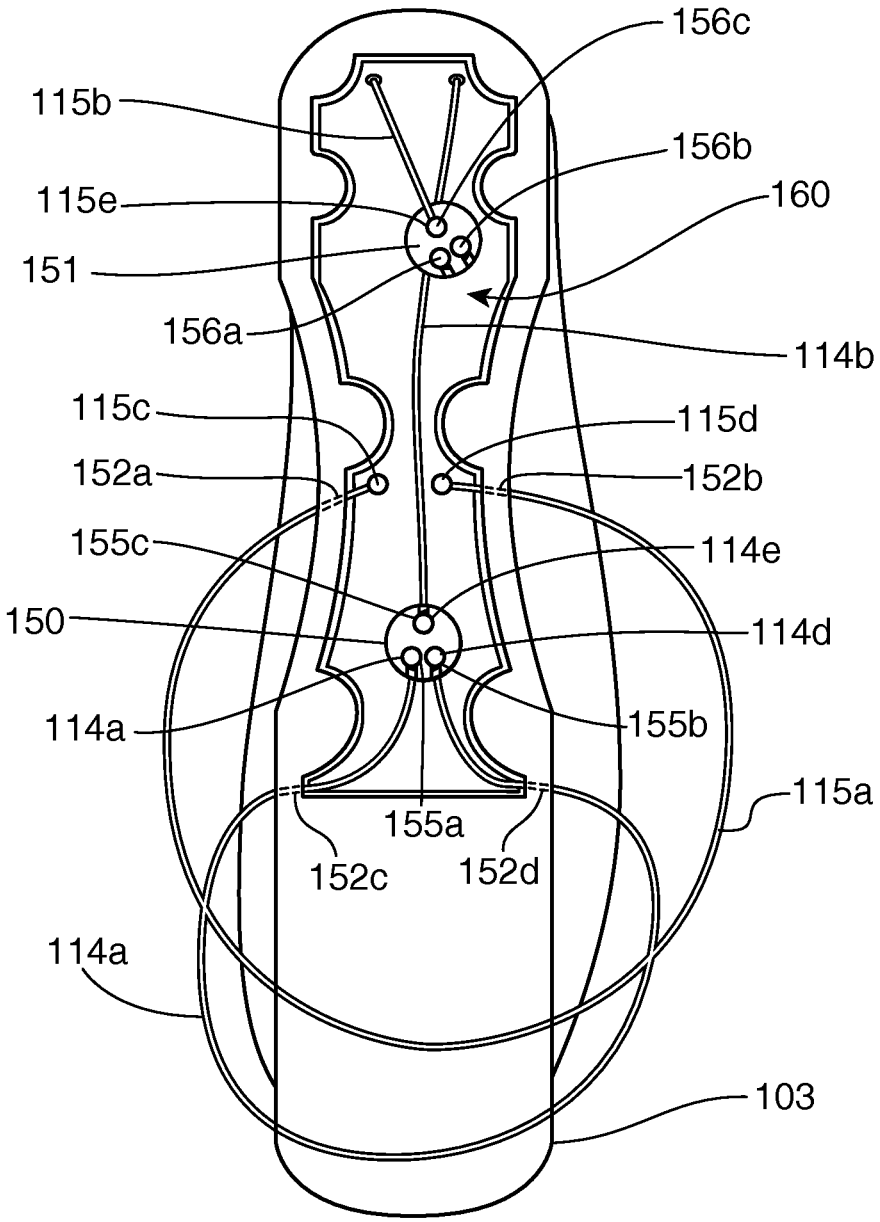
Figure 5C:
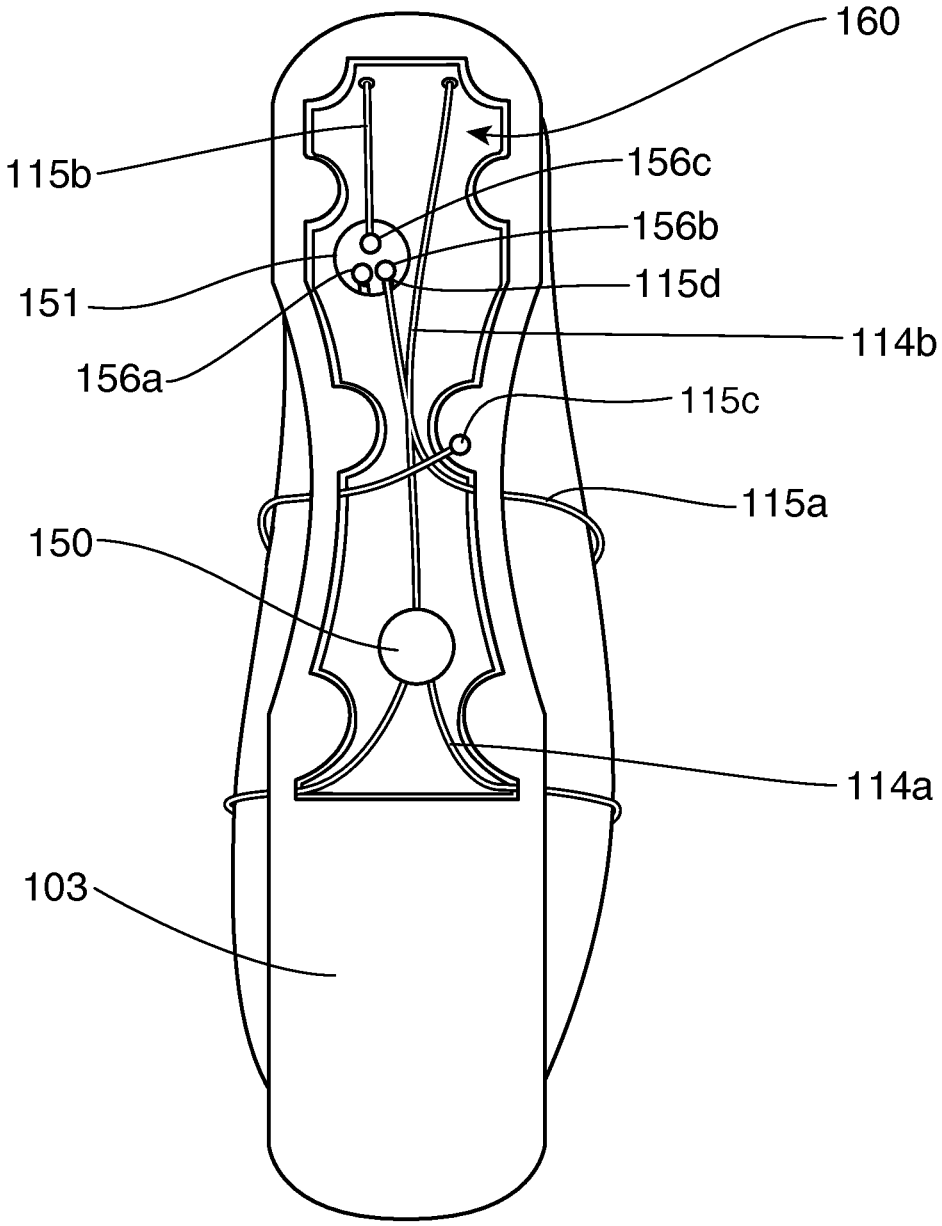
Figure 5D:
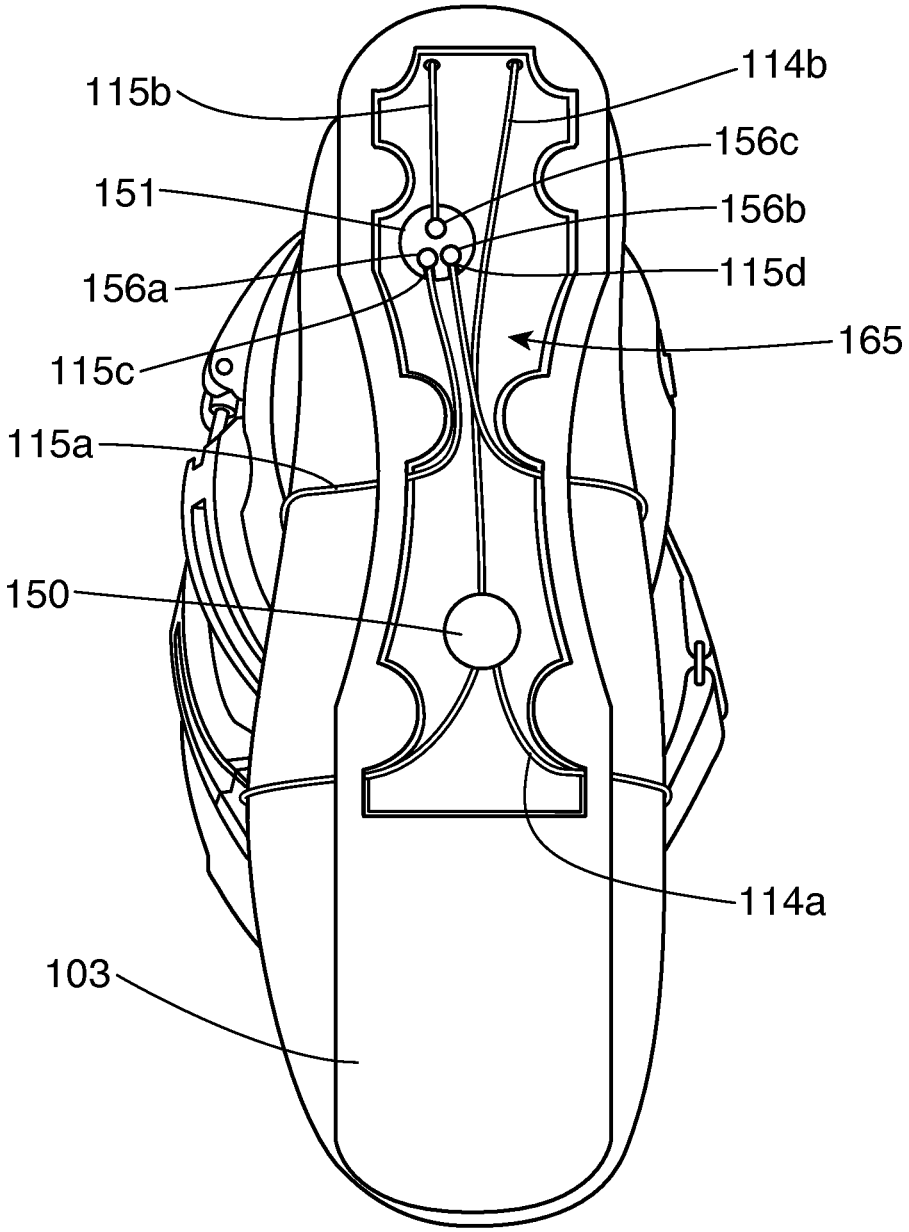

An example cable configuration is illustrated as part of an assembly process in FIGS. 5B-D. It is noted that the specific configuration is not intended to be limiting. For example, more or less terminators may be implemented, as may other configurations of the cabling and/or terminator(s). For example, a single cable may loop around the boot and through the terminator (rather than using separate cables such as 114*a* and 114*b* or 115*a* and 115*b*). Still other cabling and/or terminators may be implemented such as will be readily understood by those having ordinary skill in the art after becoming familiar with the teachings herein.

In FIG. 5B, the cable 114*a* is shown assembled to terminator 150. Cable end 115*e* has been inserted into opening 156*c* of terminator 151. In FIG. 5C, the terminator 150 has been covered (or flipped over such that the openings 155*a-c* are facing toward the top of the boot); and cable end 115*d* has been inserted into opening 156*b*. In FIG. 5D, terminator 151 has also been covered (or flipped to face the opposite direction).

In an example, the fastening system 100 include terminators 150 and 151 provided in cavity 160 or repository of the boot sole 103 (see FIGS. 5B-D). The terminators 150 and 151 may float within the cavity so that the terminators 150 and 151 move under tension of the cable. The cables 114*a* and 115*a* have ends configured for receipt within the receptacle of the disc. The repository 160 houses one or more connectors or terminators 150 and 151, as well as portions of cables 114*a-b* and 115*a-b*. A plurality of passages (e.g., drilled holes) may be provided between the repository and the sole exterior perimeter. These passages 152*a-d* allow for slidable receipt of the bodies of the cables 114*a-b* and 115*a-b* therethrough.

In the example cable configuration illustrated in FIGS. 5B-D, a first cable 114*a* has a first end 114*c* terminating in a first receptacle 155*a* of one of the terminators. The first cable 114*a* extends out of a first side of the base of the boot 100, around a foot portion of the boot 100 and into a second side of the base of the boot 100. A second end 114*d* of the first cable 114*a* terminates in a second receptacle 155*b* of the one of the terminators 150. A second cable 114*b* has a first end 114*e* terminating in a third receptacle 155*c* of the terminator 150. The second cable 114*b* extends out of a rear side of the base of the boot 100 and is attached to the handle 120 (see, e.g., FIG. 1B) mounted on rear (cuff) portion of the boot 100.

A third cable 115*a* has a first end 115*c* terminating in a first receptacle 156*a* of a second of the terminators 151. The third cable 115*a* extends out of the first side of the base of the boot 100, around the foot portion of the boot 100 and into the second side of the base of the boot 100. A second end 115*d* of the third cable 115*a* terminates in a second receptacle 156*b* of the terminator 151. A fourth cable 115*b* has a first end 115*e* terminating in a third receptacle 156*c* of the terminator 150. The fourth cable 115*b* extends out of a rear side of the base of the boot 100 and is attached to the handle 120 (see, e.g., FIG. 1B) mounted on the rear (cuff) portion of the boot 100.

Figure 5E:
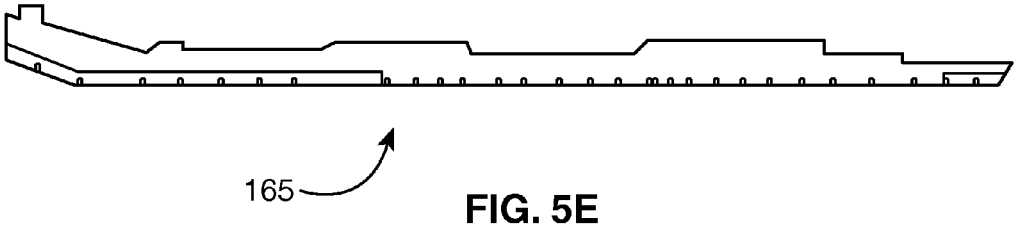
FIGS. 5E-F show an example base plate or cover for the cavity.
Figure 5F:
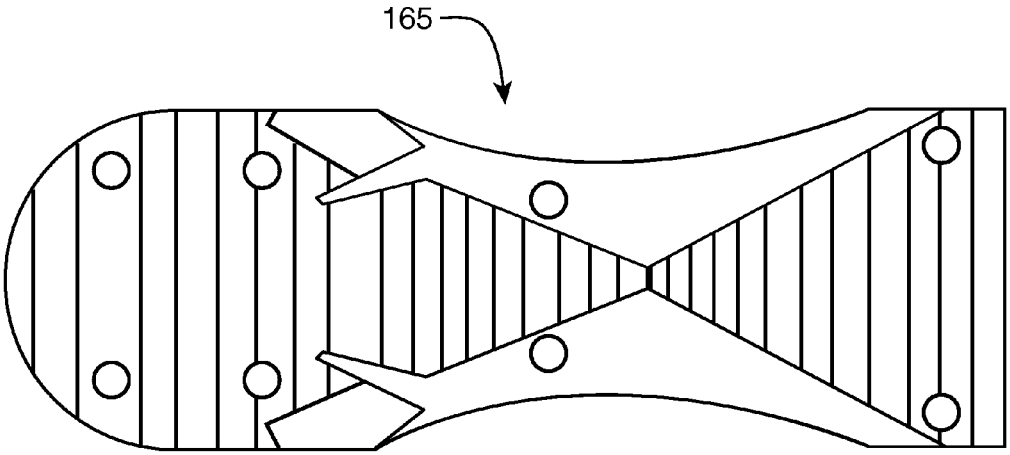

FIGS. 5E-F show an example base plate or cover for the cavity 160. The cover 165 is shown in FIGS. 5B-D as it may be removed from the cavity to assemble the cabling. The cover 165 shown in FIGS. 5E-F may be provided (e.g., snap fit or screwed on) to cover the cavity 160, e.g., after assembling the cables and/or to adjust, replace, or repair the cables and/or terminators 150-151.

During use, the cables 114*a* and 115*a* may be extended or wrapped around a foot portion of the boot 100 and tightened behind an ankle portion of the boot. 100. The lever 120 may serve to adjust tension when operated to move between an open position (to loosen) and closed position (to tighten) .The cables 114*b* and 115*b* may also be adjusted for tightness, e.g., using thumb nuts of cable tension assemblies 121 and 122 or other adjustable device on the handle 120.

In an example, the receptacles (e.g., 155*a-c*) may be formed into a bottom surface of the terminator (e.g., 151) and accessed through a perimeter of the disc-shaped terminator. In an example, the receptacles have a radial portion having a first cross section and an interior portion having a second cross section, the second cross section larger than the first cross section to securely receive enlarged ends of the first and second cables. The cables may have enlarged ends (e.g., shown as balls in FIGS. 5B-D) configured for receipt within the receptacles of the respective terminator. As such, the ends of the cables can be inserted into the terminator, and when tension is applied, the cables cannot pull out of the terminator. In an example, the terminator may be covered, e.g., using radial plates screwed or otherwise fastened on the terminator surface to assist in holding the cable ends in the terminator.

Applying opposing forces to the terminator along a first orientation applies tension to the first and second cable, and wherein applying opposing forces to the terminator along a second orientation approximately perpendicular to the first orientation disengages the cable from the disc.

In an example, the discs may have a large top and bottom surface, and a relatively small height defining a relatively small perimeter surface. A number of receptacles may be formed (e.g., machined) into one or both of the top and bottom surfaces of the connector and through the perimeter surface of the disc. The receptacle(s) may include a radial portion having a first cross section and an interior portion having a second cross section larger than the first cross section to encourage a selectable locking relationship with one or more cables.

In an example, the cables may have ends which can be removably coupled within the receptacles of connectors. It is noted that the use of a cover on the disc is optional. Another way to lock the cable connection place may be by placing the ball portion into the receptacle and forming the material around it to hold the assembly together. In another example, the connector may be designed such that the ball (or other fitting) can be positioned into the connector only one way, and it may lock when rotated. Other designs are also contemplated.

In an example, the cables may have bulbous (or other enlarged) distal tips having cross section greater than that of the cable body. The enlarged tips (or tips provided with a bulb or other enlargement) may cooperate with the interior portions of the receptacles. The cable tips and/or interior portions of the receptacles are shown as being substantially round, although any geometry may be used (e.g., square, diamond, pyramid, etc.).

During use, the connectors serves as joint areas for single ball shanks swaged at each end of the cables. The cable ends are coupled to connectors by receipt within connector receptacles. Opposing forces may be applied to the disc and cable along a first orientation, which effectively serves to provide tension to the cable.

It can be seen that pulling a cable that is engaged with a connector in a radial direction causes a binding of the increased cross section distal tip with the decreased cross-section of the receptacle radial portion and prevents disengagement of the cable and connector.

In an example, cable guides may also be provided inside the repository adjacent to the passages, for example, to push the cables into a straighter orientation, thus reducing or altogether preventing erosion of the passages by relative motion of the cables.

The tightening system may include any number of forward passages, medial passages and rear passages. Greater or fewer passages than shown may be provided, e.g., depending on the number of cables used within the system In an example, the rear passages may have an orientation approximately perpendicular to the forward and medial passages to divert cables to an exterior heel portion of the ski boot.

Figure 6A:
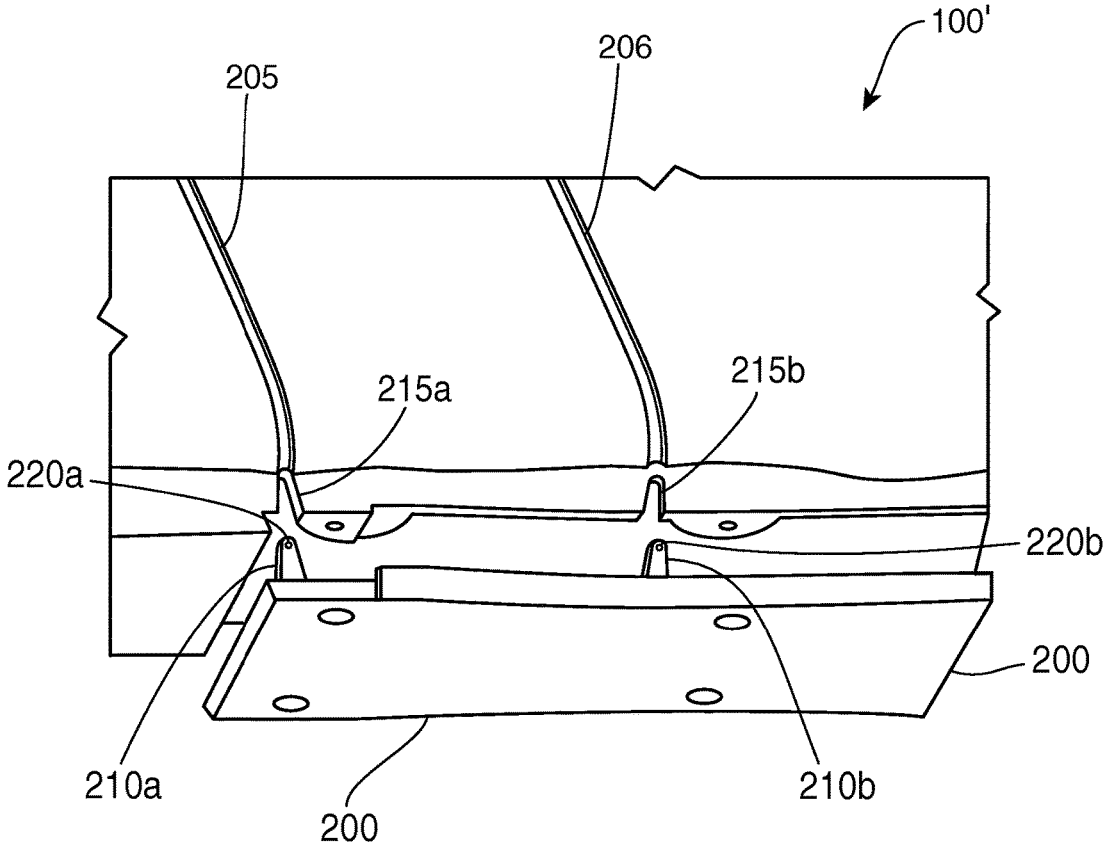
FIGS. 6A-C illustrate another example cover for the example sport boot.
Figure 6B:
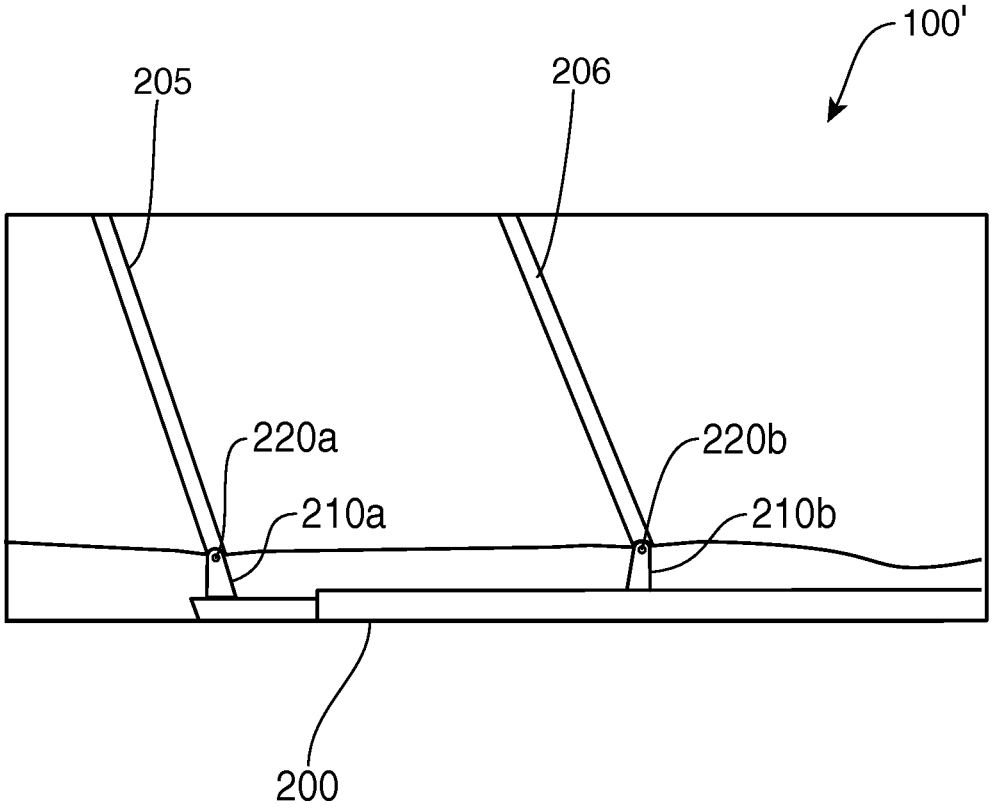
Figure 6C:
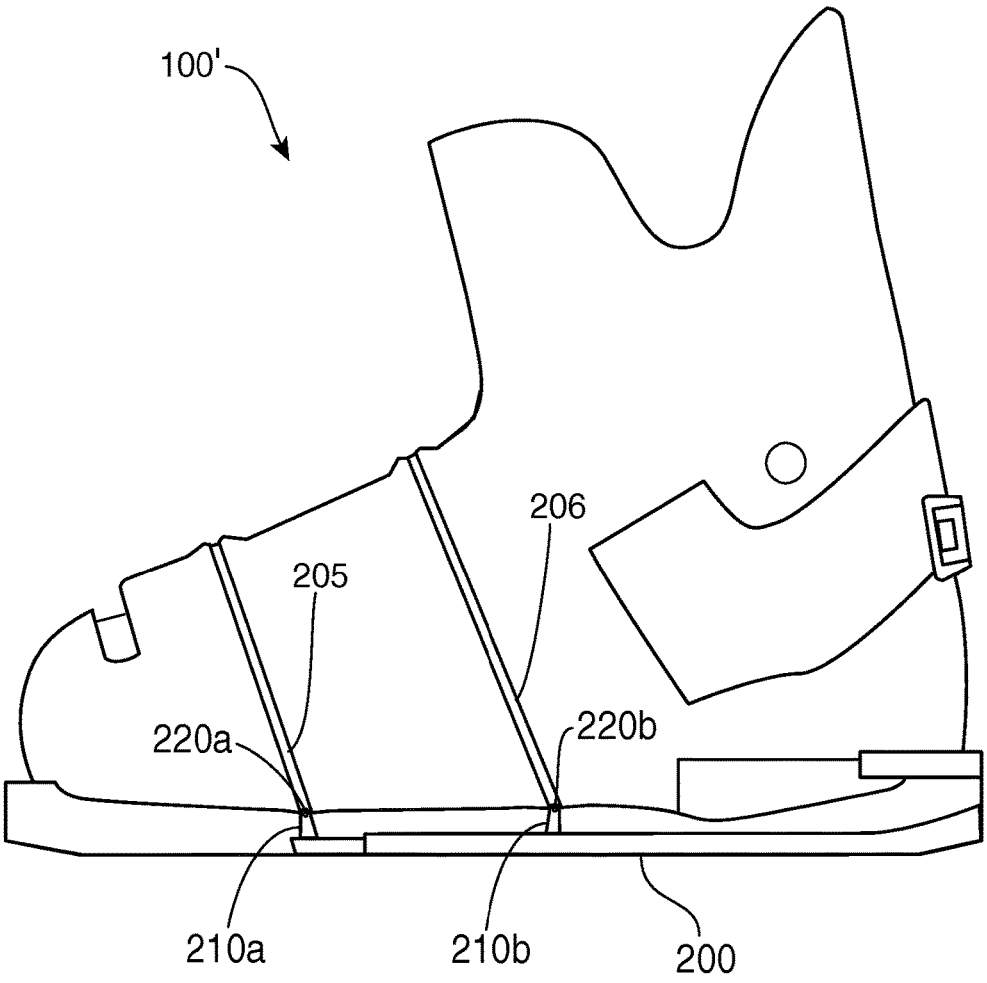

FIGS. 6A-C illustrate another example cover 200 for the example sport boot 100'. The cover 200 is shown in FIG. 6A as it may be removed from the cavity of the boot to assemble the cabling. The cover 200 may be provided (e.g., snap fit or screwed on) to cover the cavity in the sole of the boot, as illustrated by FIGS. 6B-C. It is also noted that the cover 200 includes male brackets. Brackets 210*a-b* are visible in FIGS. 6A-C, although it is understood that more brackets may be provided, e.g., on the opposite side. Male brackets 210*a-b* are configured to fit within female receivers (e.g., 215*a-b* are visible) formed in the sole of the boot, as can be seen when comparing FIG. 6A to FIGS. 6B-D. Male brackets (e.g., 210*a-b*) may provide an alignment mechanism (i.e., aligning the openings 220*a-b* in the male brackets with channels 205 and 206 for the cables. In addition, the holes or openings 220*a-b* in the male brackets 210*a-b* also provide openings (without need for drilling holds in the boot) for the cables to extend out of the cavity 201 formed in the sole of the boot.

Figure 6D:
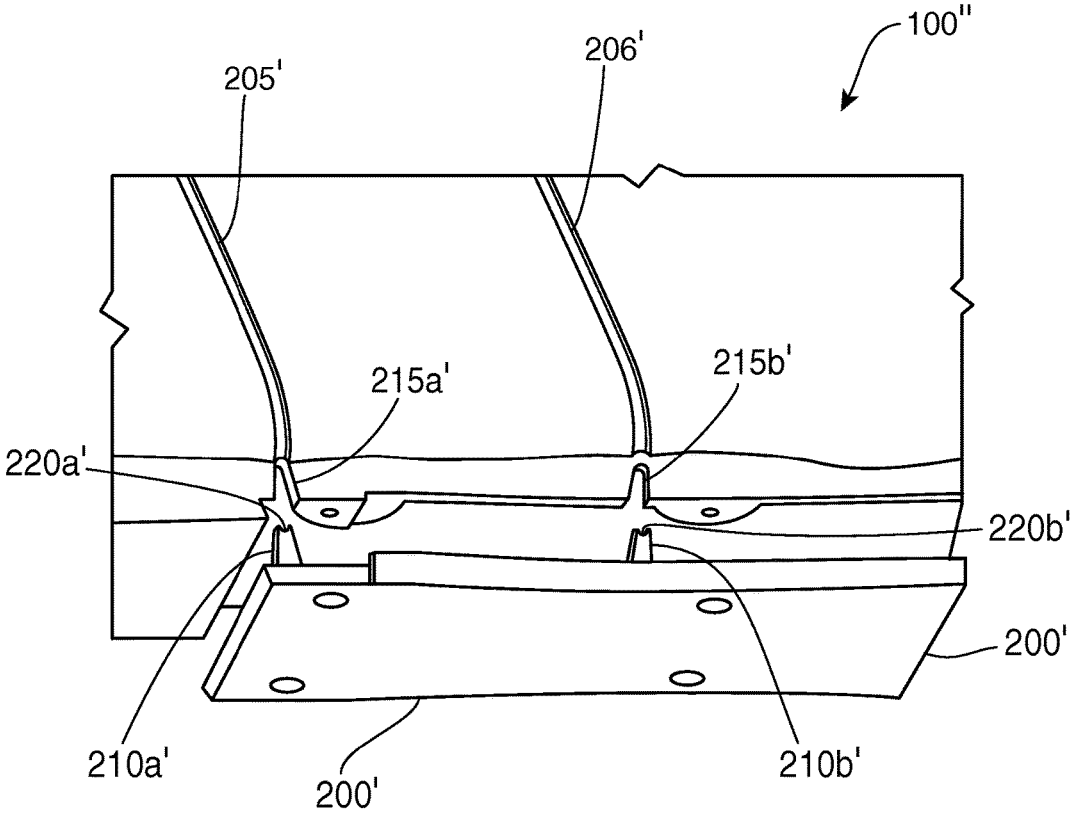
FIG. 6D illustrates another example cover for the example sport boot.

FIG. 6D illustrates another example cover for the example sport boot 100". The cover 200' is shown in FIG. 6D as it may be removed from the cavity 201' of the boot 100" to assemble the cabling. The cover 200' may be provided (e.g., snap fit or screwed on) to cover the cavity in the sole of the boot, as illustrated by FIGS. 6B-C. It is also noted that the cover 200' includes male brackets. Brackets 210'*a-b* are visible in FIG. 6D, although it is understood that more brackets may be provided, e.g., on the opposite side. Male brackets 210'*a-b* are configured to fit within female receivers (e.g., 215'*a-b* are visible) formed in the sole of the boot. Male brackets (e.g., 210'*a-b*) may provide an alignment mechanism (i.e., aligning the openings 220'*a-b* in the male brackets with channels 205' and 206' for the cables. In addition, the substantially U-shaped openings 220'*a-b* in the top portion of the male brackets 210'*a-b* also provide openings (without need for drilling holds in the boot) for the cables to extend out of the cavity 201' formed in the sole of the boot.

Figure 7A:
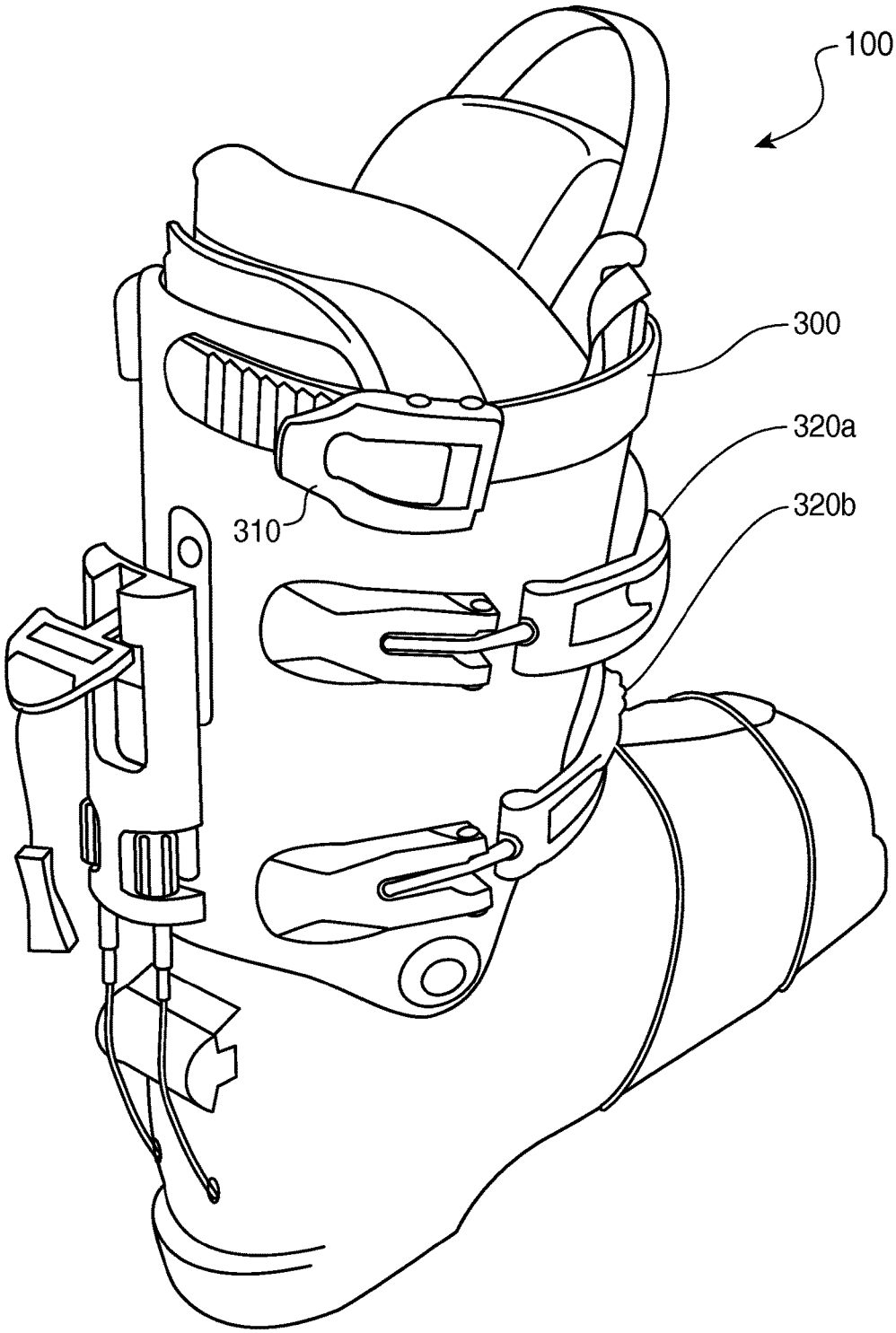
FIGS. 7A-B illustrate an example power strap for the example sport boot.
Figure 7B:
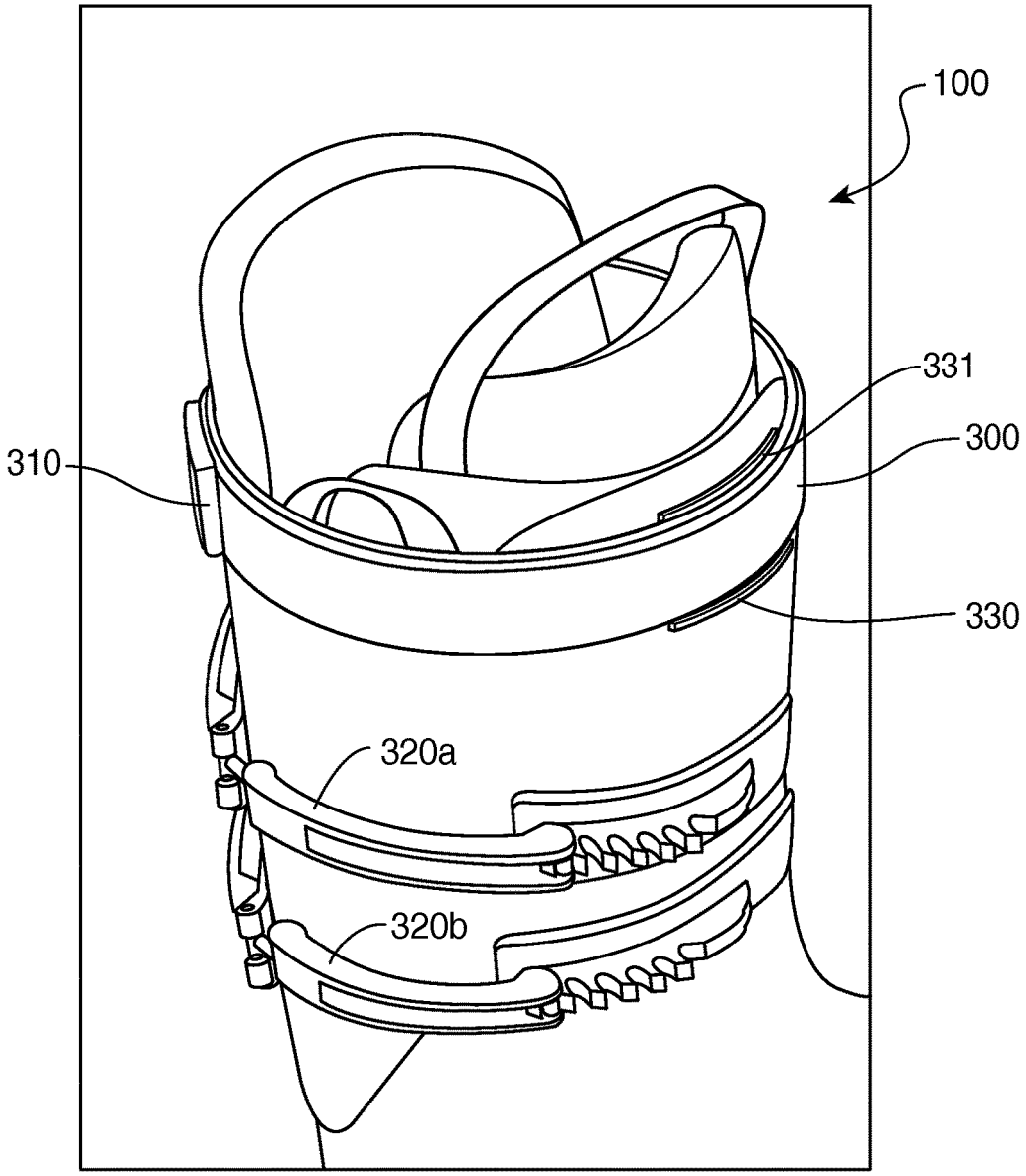

FIGS. 7A-B illustrate an example power strap 300 for the example sport boot. The power strap 300 may be configured to tighten around the front upper ankle portion of the sport boot. The power strap 300 may include a tightening mechanism 310. Conventional lower straps 320*a-b* may also be provided and configured to tighten around the leg shaft of the body.

In an example, the power strap 300 includes an adjustable type device (e.g., ratchet buckle, latch, hook-and-loop fastener). In an example, the power strap 300 may include a micro-adjustable buckle. The power strap 300 can also be adjustable to accommodate various leg shaft sizes.

One or more lower ridge 330 may also be provided and configured to reduce or prevent slipping of the power strap 300 in a downward direction on the front upper ankle portion of the boot. The power strap 300 may also be held in place by an upper ridge 331 or other anti-slip device that reduces or altogether prevents slippage of the power strap 300 in the upward direction.

Figure 8A:
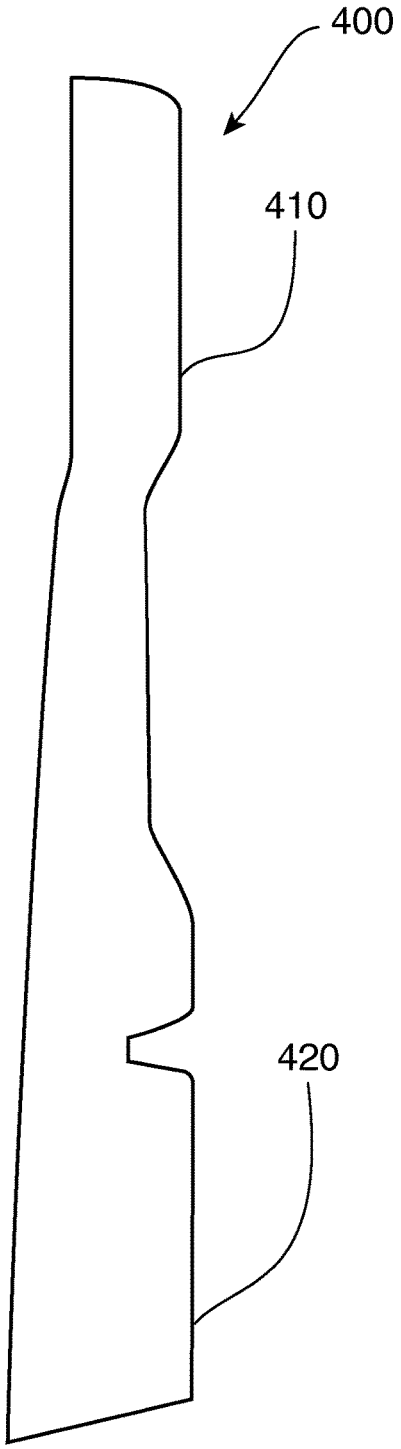
FIGS. 8A-B, 9A-C, and 10A-E illustrate example boot boards or "zeppas" for the example sport boot.
Figure 8B:
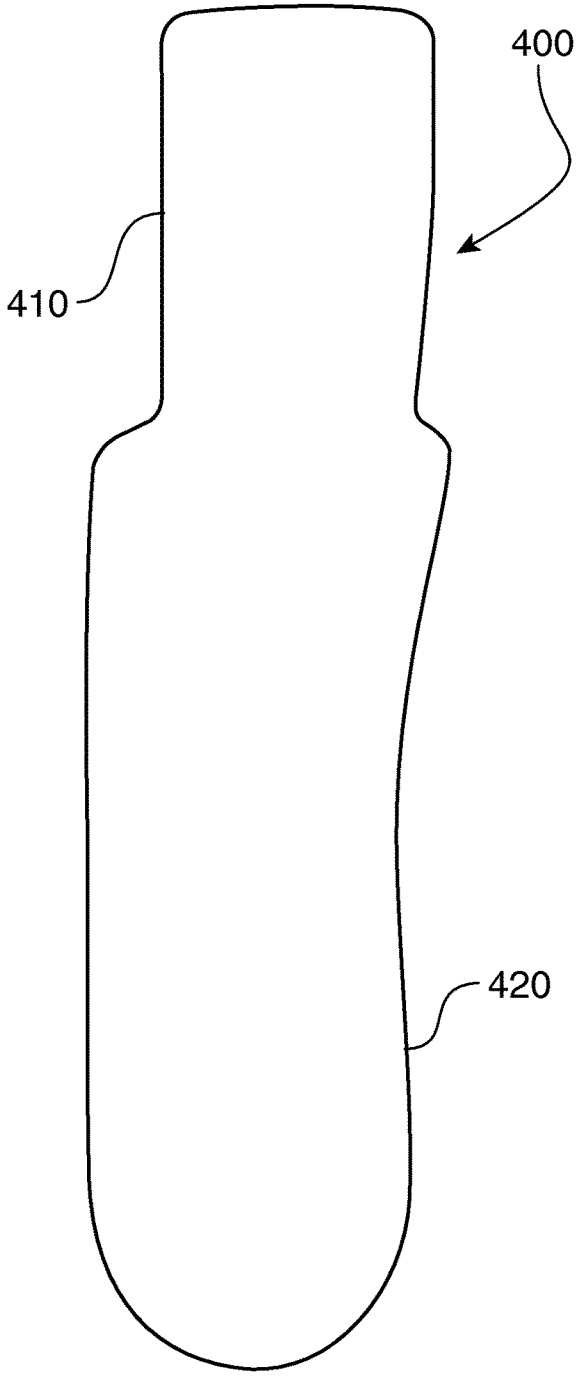
Figure 9A:
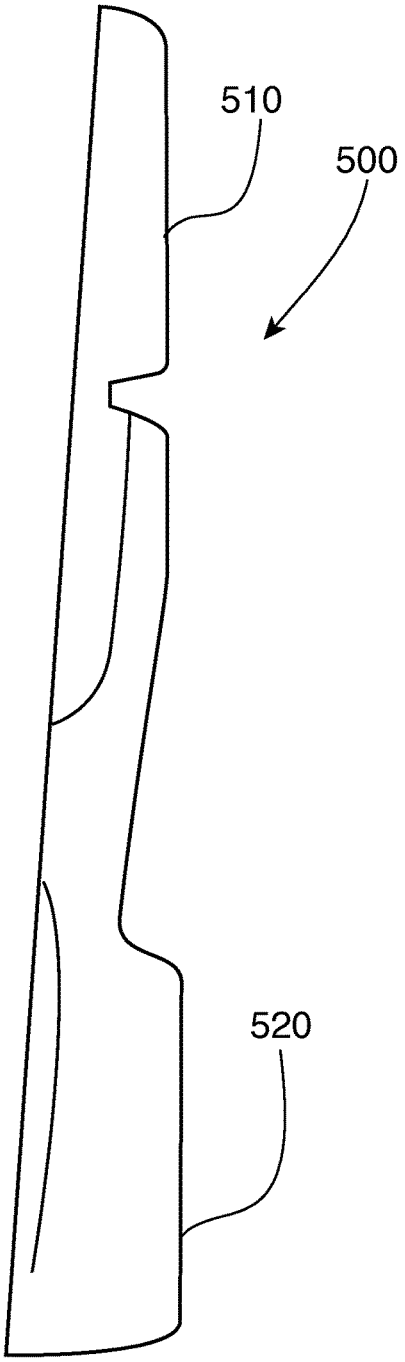
Figure 9B:
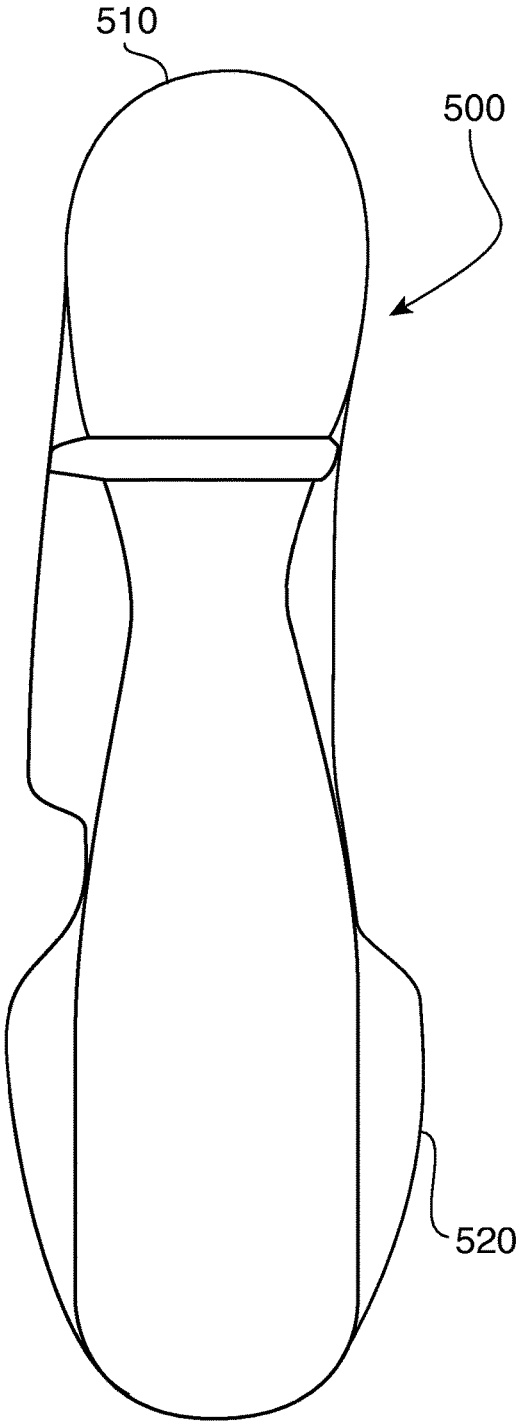
Figure 9C:
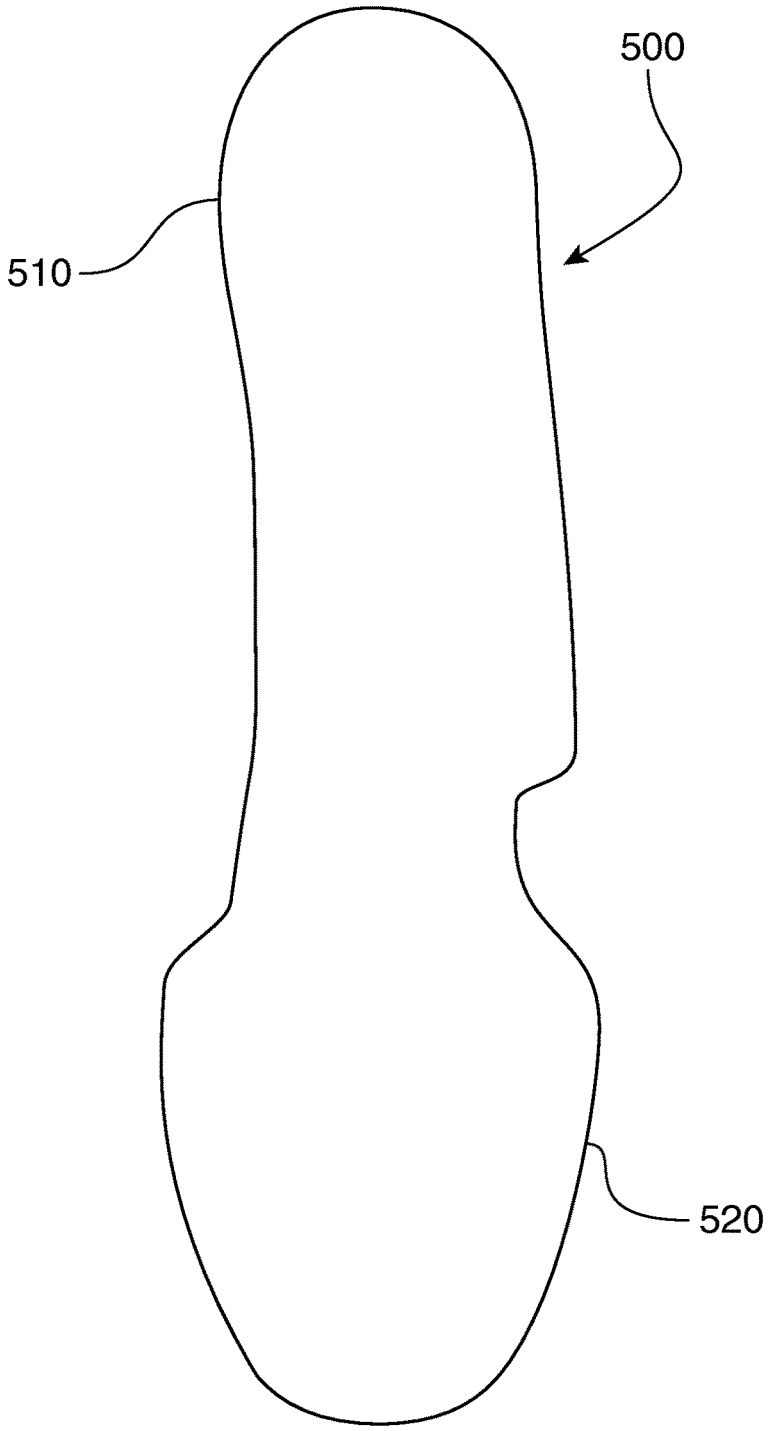
Figure 10A:
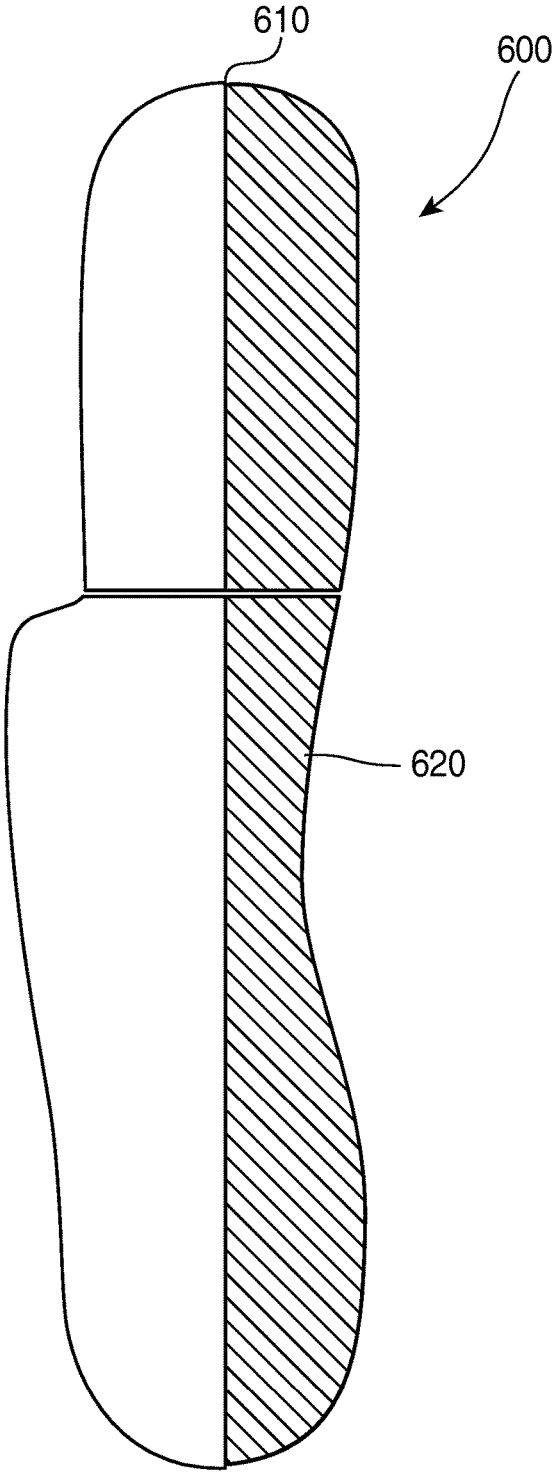
Figure 10B:
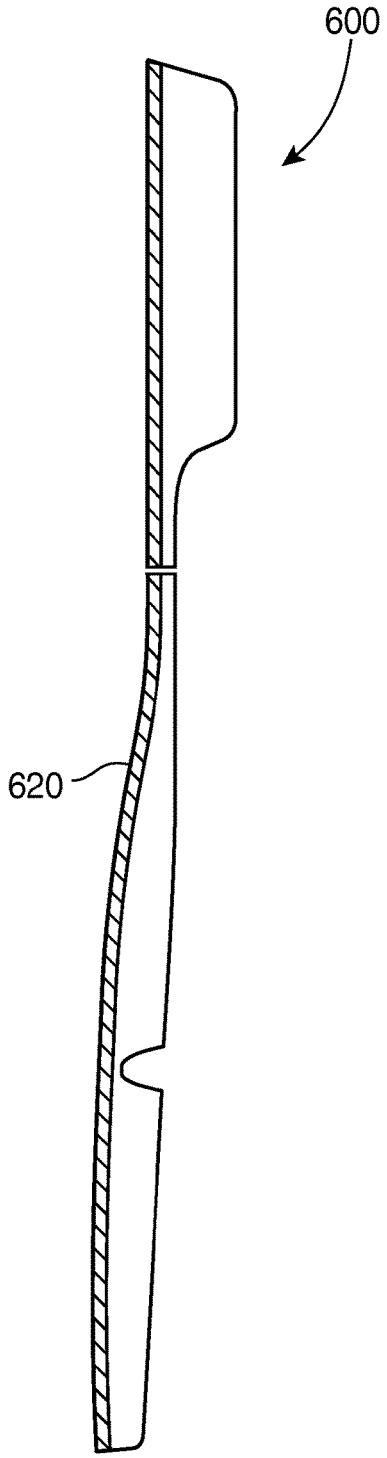
Figure 10C:
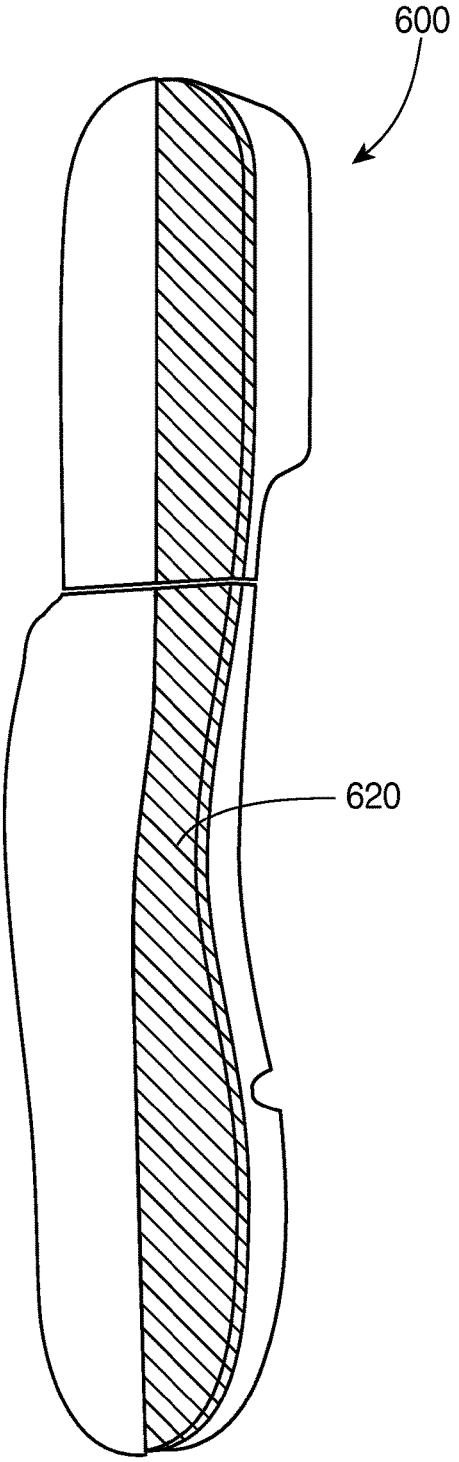
Figure 10D:
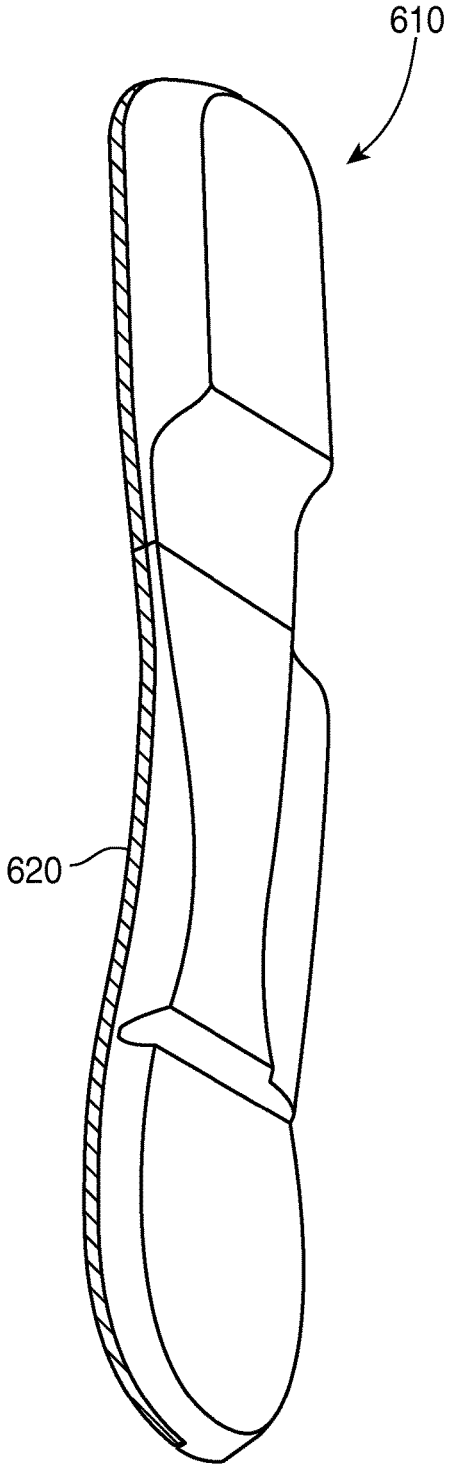
Figure 10E:
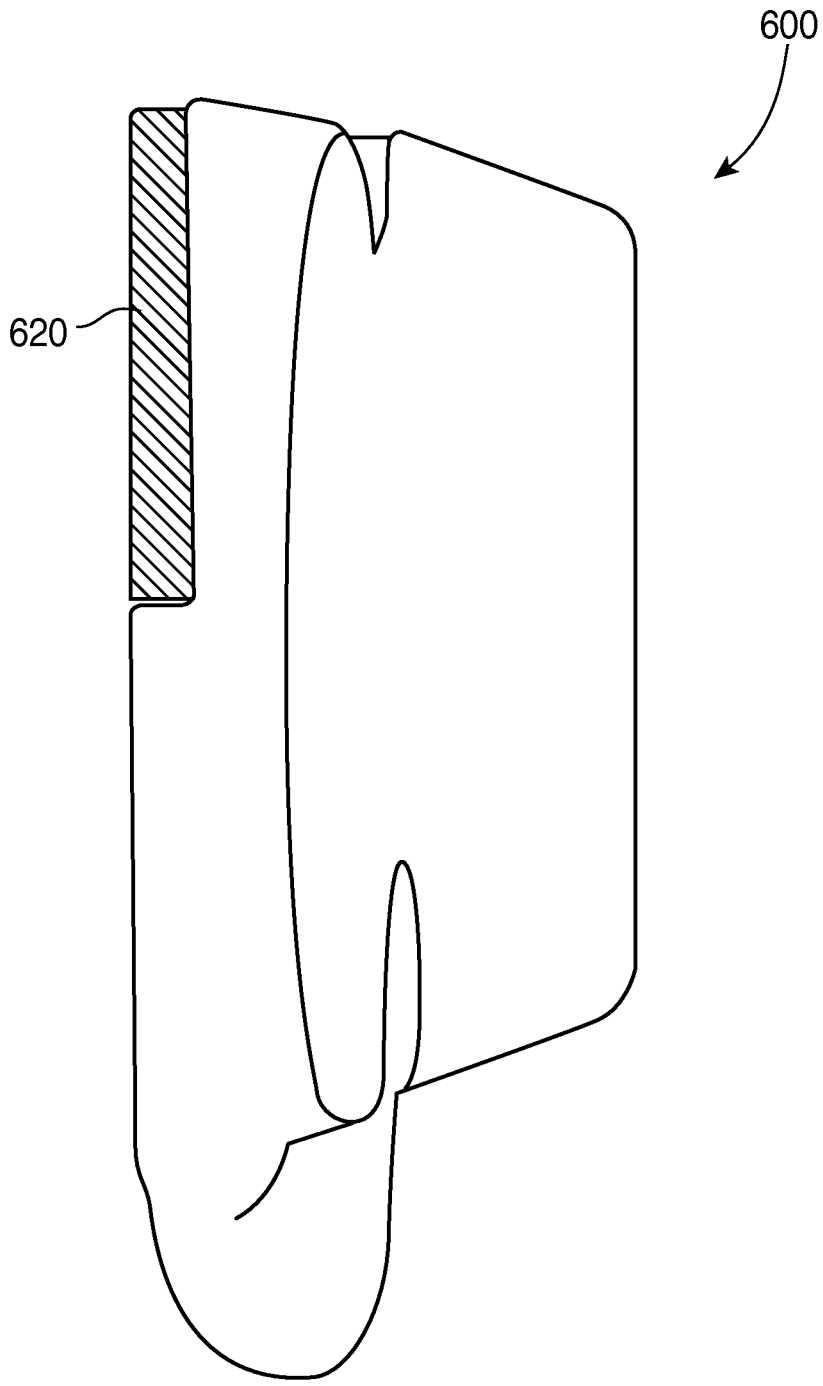

FIGS. 8A-B, 9A-C, and 10A-E illustrate example boot boards or "zeppas" for the example sport boot. FIG. 8A is a side view; FIG. 8B is a top view. FIG. 9A is a side view; FIG. 9B is a bottom view; and FIG. 9C is a top view. FIG. 10A is a top view; FIG. 10B is a side view; FIG. 10C is a top perspective view; FIG. 10D is a bottom perspective view, and FIG. 10E is a perspective view looking at the front of the toe of the board toward the heel section.

The boot boards include a heel section which slopes down to the toe section. Such a configuration provides the user with more control, e.g., for turning during use. By lifting the toes, pressure is relieved from the toes and places most of the force onto the ball of the user's foot. This also allows the toes to relax during skiing and accordingly, reduce fatigue to the toes.

In FIGS. 8A-B and 9A-C, the example boot boards 400 and 500, respectively, each include a first bottom surface spaced apart a perpendicular distance from second bottom surface. It can be seen in this example, that the rear or heel end 420 and 520 is angled downward, and the front or toe end 410 and 510 is angled upward.

In FIGS. 10A-E, the example boot board 600 may be split 610 down the center and steps down on the medial side. The step enables a foam portion 620 (e.g., 3 mm foam portion) in this area so that the foot can articulate. In an example, the medial side of the board 600 has a step down of 3 mm and runs the entire length from toe to heel of the boot board. A firm foam 620 may be positioned in this step down area so that the surface across the top is flat for the foot to sit upon. The result is that when pressure is applied by the foot, the foam yields slightly and allows the rest of the foot structure to articulate. Different density foams can be used to create varied results for different types of feet.

Before continuing, it should be noted that the examples described above are provided for purposes of illustration, and are not intended to be limiting. Other devices and/or device configurations may be utilized to carry out the operations described herein.

An example method assembling a cable to a disc for tightening a ski boot may include providing a disc including a receptacle in a base of the ski boot, receiving ends of a cable in the receptacle of the disc, and moving the cable to tighten the ski boot. Where two fastening assemblies are used, the method further includes providing a second disc including a receptacle in the base of the ski boot, receiving ends of a second cable in the receptacle of the second disc, and moving the second cable to tighten the ski boot.

In an example, the method includes moving both the first and the second cables at the same time to tighten the ski boot. Moving both the first and the second cables may be by a lever on a back rear (cuff) portion of the ski boot. The method may further include moving the cable over a cable wear guide on a back of the rear (cuff) portion of the ski boot.

By way of illustration, a body of the cable is slidably received through the forward passages such that the cable is encompassed by a cavity or repository formed in the sole of the boot, and a first arc is formed by the cable around a boot toe. The body of the cable may be slidably received through medial passages such that the two ends of the cable are encompassed by the repository and a second arc is formed around a boot mid-foot. The body of the cable may be slidably received through the rear passages such that one end of the cable is encompassed by the repository. The body of the cable may also be slidably received through the rear passages, such that one end of cable is encompassed by the repository.

Cable ends may be coupled by connectors on the lever handle of the boot. In an example, the lever on the back of the boot is raised into a closed position to tighten the cable. A cable tension adjuster may be further operated, e.g., by rotation of a first knob in a first direction to increase tension in cable (while rotation of the first knob in a second direction decreases tension in the cable). A second end of cable may be coupled with a cable tension adjuster, wherein rotation of a second knob in a first direction increases tension in the cable (while rotation of the first knob in a second direction decreases tension in the cable).

The operations shown and described herein are provided to illustrate example implementations. It is noted that the operations are not limited to the ordering shown. Still other operations may also be implemented.

It is noted that the examples shown and described are provided for purposes of illustration and are not intended to be limiting. Still other examples are also contemplated.

The invention claimed is:

1. A sport boot comprising:

a first terminator provided in a cavity formed in a base of the sport boot, the first terminator having a at least three separate receptacles formed therein, a first receptacle and a second receptacle both oriented toward a toe-end of the sport boot, and a third receptacle oriented toward a heel-end of the sport boot;

a first cable having a first end terminating in the first receptacle of the first terminator, the first cable extending out of a first side of the base of the sport boot, around a foot portion of the sport boot and into a second side of the base of the sport boot, and a second end of the first cable terminating in the second receptacle of the first terminator; and a second cable having a first end terminating in the third receptacle of the first terminator, the second cable extending out of a rear side of the base of the sport boot and attached to a handle mounted on the rear portion of the sport boot.

2. The sport boot of claim 1, further comprising:

a second terminator provided in the cavity formed in the base of the sport boot;

a third cable having a first end terminating in a first receptacle of the second terminator, the third cable extending out of the first side of the base of the sport boot, around the foot portion of the sport boot and into the second side of the base of the sport boot, and a second end of the third cable terminating in a second receptacle of the second terminator; and a fourth cable having a first end terminating in a third receptacle of the second terminator, the fourth cable extending out of a rear side of the base of the sport boot and attached to the handle mounted on the rear portion of the sport boot.

3. The sport boot of claim 1, wherein the first terminator is a disc.

4. The sport boot of claim 1, wherein the first and second cable each have enlarged ends configured for receipt within the receptacles of the first terminator.

5. The sport boot of claim 1, wherein the receptacles are formed into a bottom surface of the first terminator and accessed through a perimeter of the first terminator.

6. The sport boot of claim 1, wherein the receptacles have a radial portion having a first cross section and an interior portion having a second cross section, the second cross section larger than the first cross section to securely receive enlarged ends of the first and second cables.

7. The sport boot of claim 1, wherein applying opposing forces to the first terminator along a first orientation applies tension to the first and second cable, and wherein applying opposing forces to the first terminator along a second orientation approximately perpendicular to the first orientation disengages the cable from the first terminator.

8. The sport boot of claim 1, further comprising a cable wear guide mounted outside on a back side of the rear portion of the sport boot under the handle to straighten the cables before entering a back buckle area of the sport boot, wherein the second and fourth cables slide over the cable wear guide.

9. The sport boot of claim 1, wherein the second and fourth cable are attached to the handle via adjustable connectors to tighten and loosen the second and fourth cables at the handle.

10. The sport boot of claim 1, further comprising a power strap configured to tighten around a front upper ankle portion of the sport boot.

11. The sport boot of claim 10, further comprising a ridge configured to reduce or prevent slipping of the power strap in an upward and downward direction on the front upper ankle portion of the sport boot.

12. The sport boot of claim 1, further comprising a boot board inside the sport boot, the boot board having first and second angled bottom surfaces, and a step down on a medial side encompassing a foam piece which aids the user's foot to articulate.

13. A fastening system for a boot, comprising:

a plurality of substantially disc-shaped terminators embedded in a base portion of the boot, each of the terminators having at least three separate receptacles, a first receptacle and a second receptacle both oriented toward a toe-end of the boot, and a third receptacle oriented toward a heel-end of the boot; and at least one cable having ends removably coupling with at least one of the plurality of receptacles.

14. The fastening system of claim 13, wherein a first end of a first cable is coupled to a first terminator and a first end of a second cable is coupled to a second terminator.

15. The fastening system of claim 14, further comprising a cable tension adjuster on a lever handle coupled with a second end of the first cable and a second end of the second cable, wherein operating the lever handle increases and decreases tension in the cables.

16. The fastening system of claim 13, further comprising:

a first cable having a first end terminating in a first receptacle of one of the terminators, the first cable extending out of a first side of the base of the sport boot, around a foot portion of the sport boot and into a second side of the base of the sport boot, and a second end of the first cable terminating in a second receptacle of the one of the terminators;

a second cable having a first end terminating in a third receptacle of the one of the terminators, the second cable extending out of a rear side of the base of the sport boot and attached to a handle mounted on the rear portion of the sport boot;

a third cable having a first end terminating in a first receptacle of a second of the terminators, the third cable extending out of the first side of the base of the sport boot, around the foot portion of the sport boot and into the second side of the base of the sport boot, and a second end of the third cable terminating in a second receptacle of the second of the terminators; and a fourth cable having a first end terminating in a third receptacle of the second of the terminators, the fourth cable extending out of a rear side of the base of the sport boot and attached to the handle mounted on the rear portion of the sport boot.

17. The fastening system of claim 13, wherein the at least one cable has enlarged ends configured for receipt within the receptacles of the at least one terminator.

18. A method of assembling a cable to a disc for tightening a ski boot, comprising:

providing a disc including at least three separate receptacles in a base of the ski boot, a first receptacle and a second receptacle both oriented toward a toe-end of the ski boot, and a third receptacle oriented toward a heel-end of the ski boot;

receiving ends of at least one cable in the three separate receptacles of the disc; and moving the cable to tighten the ski boot.

19. The method of claim 18, further comprising:

providing a second disc including a receptacle in the base of the ski boot;

receiving ends of a second cable in the receptacle of the second disc; and moving the second cable to tighten the ski boot.

20. The method of claim 19, further comprising moving both the first and the second cables at the same time over a cable wear guide mounted outside on a back of the rear portion of the ski boot to straighten the cables before entering a back buckle area of the ski boot and to tighten the ski boot by a lever on a back of the rear portion of the ski boot.

* * * * *